US010488795B2

(12) United States Patent
Tanaka et al.

(10) Patent No.: US 10,488,795 B2
(45) Date of Patent: Nov. 26, 2019

(54) FIXING DEVICE FOR FIXING AN IMAGE ON A RECORDING MATERIAL AND INCLUDING A HEAT-CONDUCTIVE MEMBER WITH A REGULATING PORTION

(71) Applicant: CANON KABUSHIKI KAISHA, Tokyo (JP)

(72) Inventors: Masashi Tanaka, Kawasaki (JP); Shoichiro Ikegami, Yokohama (JP); Kensuke Umeda, Kawasaki (JP); Sho Taguchi, Fujisawa (JP); Ai Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/287,987

(22) Filed: Oct. 7, 2016

(65) Prior Publication Data

US 2017/0102651 A1 Apr. 13, 2017

(30) Foreign Application Priority Data

Oct. 9, 2015 (JP) ..... 2015-200965

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2042; G03G 15/2046; G03G 15/2053; G03G 15/2078; G03G 15/2082
See application file for complete search history.

(56) References Cited

U.S. PATENT DOCUMENTS 8,798,514 B2 8/2014 Tanaka et al.
9,235,172 B2 1/2016 Imaizumi et al.
(Continued)

FOREIGN PATENT DOCUMENTS

JP H10-213980 A 8/1998
JP 2014130241 A 7/2014
(Continued)

OTHER PUBLICATIONS

Japanese Office Action issued in corresponding Japanese Application No. 2015-200965 dated Jul. 23, 2019.

*Primary Examiner* — Thomas S Giampaolo, II
(74) *Attorney, Agent, or Firm* — Venable LLP

(57) ABSTRACT

A fixing device includes a belt, a heater, and a pressing member for forming a nip through the belt in cooperation with the heater. The nip includes a region at which a width of the nip with respect to a feeding direction of a recording material gradually increases from a longitudinal central portion toward a longitudinal end portion, and a pressure of the nip gradually increases from the longitudinal central portion toward the longitudinal end portion. A heat-conductive member includes a regulating portion for regulating movement thereof relative to a supporting member in a longitudinal direction of the heater. The regulating portion is provided in a region of the heat-conductive member corresponding to a position of the nip closer to the longitudinal end portion than to the longitudinal central portion, and a bias member is provided outside of the region of the heat-conductive member corresponding to the position of the nip.

3 Claims, 14 Drawing Sheets

(56) References Cited

U.S. PATENT DOCUMENTS

| | | | | |
|---|---|---|---|---|
| 9,766,578 | B2 * | 9/2017 | Narahara | G03G 15/2053 |
| 2009/0067901 | A1 | 3/2009 | Lee | |
| 2011/0100972 | A1 | 5/2011 | Ikegami et al. | |
| 2014/0153982 | A1 * | 6/2014 | Adachi | G03G 15/2028<br>399/329 |
| 2014/0186078 | A1 * | 7/2014 | Imaizumi | G03G 15/2017<br>399/329 |
| 2016/0098001 | A1 * | 4/2016 | Ogawa | G03G 15/2053<br>399/338 |

FOREIGN PATENT DOCUMENTS

| | | | |
|---|---|---|---|
| JP | 2014238560 | A | 12/2014 |
| JP | 2015-049368 | A | 3/2015 |
| JP | 2015043075 | A | 3/2015 |

* cited by examiner (a)

(b)

(a)

(b)

FIXING DEVICE FOR FIXING AN IMAGE ON A RECORDING MATERIAL AND INCLUDING A HEAT-CONDUCTIVE MEMBER WITH A REGULATING PORTION

This application claims the benefit of Japanese Patent Application No. 2015-200965, filed on Oct. 9, 2015, which is hereby incorporated by reference herein in its entirety.

FIELD OF THE INVENTION AND RELATED ART

The present invention relates to a fixing device (image heating apparatus) suitable as a fixing device to be mounted in an image forming apparatus of an electrophotographic type, such as a copying machine or a laser beam printer.

Conventionally, fixing devices of a heating roller type, a film (belt) heating type, and the like, have been known. Japanese Laid-Open Patent Application No. 2014-238560 discloses an image heating apparatus (fixing device) of the film heating type in which a heat-conductive member is provided on a back surface of a heater, and thus, a so-called non-sheet-passing portion temperature rise (temperature rise at non passing portion of a recording material) is suppressed. This apparatus solves a problem such that a non-sheet-passing portion temperature rise suppressing effect lowers due to a shift of the heat-conductive member relative to a supporting member, by providing the heat-conductive member with locking portions at end portions with respect to a recording material feeding direction and by locking the heat-conductive member to the supporting member with the locking portions with respect to a direction perpendicular to the recording material feeding direction.

The present invention is directed to a further improvement of the above-described fixing device. Specifically, even when a preventing portion is provided for preventing positional deviation of the heat-conductive member with respect to a longitudinal direction, in some cases, when a heat cycle was repeated, the heat-conductive member was positionally deviated (shifted) from the heater. Particularly, in a case in which an aluminum material having a high thermal conductivity is used as the heat-conductive member, and in a case in which the heat-conductive member is decreased in thickness and is used for suppressing thermal capacity, in some cases, a strength of the heat-conductive member was weak and was lower than a force of movement of the heat-conductive member due to thermal expansion, so that the preventing portion was deformed and thus, the heat-conductive member was positionally deviated.

When the preventing portion of the heat-conductive member was deformed, a contact surface with the heater was also deformed and thus, a contact property with the heater was lowered in some cases. When the heat-conductive member is spaced from the heater, the heater increases in temperature (temperature rise) at that portion, so that temperature non-uniformity generates with respect to a longitudinal direction of the heater. It would also be considered that the longitudinal temperature non-uniformity causes first defect as uneven glossiness on an image and that heat loss of a heater holder and a pressing roller is caused when a degree of the temperature rise of the heater is high. Further, when the heat-conductive member is positionally deviated from the heater by the heat cycle, as described above, it would be considered that improper fixing at the end portion and breakage of the fixing member generate.

SUMMARY OF THE INVENTION

According to one aspect, the present invention provides a fixing device for fixing an image on a recording material, the fixing device comprising a cylindrical belt, a heater for heating the belt, the heater including an elongated substrate and a heat generating resistor provided on the substrate, a heat-conductive member contacting a surface of the heater opposite from a belt contacting surface of the heater, wherein the heat-conductive member has a thermal conductivity greater than that of the substrate, a supporting member for supporting the heater through the heat-conductive member, and a pressing member for forming a nip through the belt in cooperation with the heater, wherein, in the nip, the image is fixed on the recording material by being heated while the recording material, on which the image is formed, is fed, wherein the nip includes a region at which a width of the nip with respect to a feeding direction of the recording material gradually increases from a longitudinal central portion toward a longitudinal end portion, and wherein the heat-conductive member includes a preventing portion for preventing movement thereof relative to the supporting member in a longitudinal direction of the heater, the preventing portion being provided in a region of the heat-conductive member corresponding to a position of the nip closer to the longitudinal end portion than to the longitudinal central portion.

According to another aspect, the present invention provides a fixing device for fixing an image on a recording material, the fixing device comprising a cylindrical belt, a heater for heating the belt, and heater including an elongated substrate and a heat generating resistor provided on the substrate, a heat-conductive member contacting a surface of the heater opposite from a belt contacting surface of the heater, wherein the heat-conductive member has thermal conductivity greater than that of the substrate, a supporting member for supporting the heater through the heat-conductive member, and a pressing member for forming a nip through the belt in cooperation with the heater, wherein, in the nip, the image is fixed on the recording material by being heated while the recording material on which the image is formed is fed, wherein the nip includes a region at which a width of the nip with respect to a feeding direction of the recording material gradually increases from a longitudinal end portion toward a longitudinal central portion, and wherein the heat-conductive member includes a preventing portion for preventing movement thereof relative to the supporting member in a longitudinal direction of the heater, the preventing portion being provided in a region of the heat-conductive member corresponding to a position of the nip closer to the longitudinal central portion than to the longitudinal end portion.

Further features of the present invention will become apparent from the following description of exemplary embodiments with reference to the attached drawings.

DESCRIPTION OF THE PREFERRED EMBODIMENTS

Embodiment 1

Image Forming Apparatus

Figure 2:
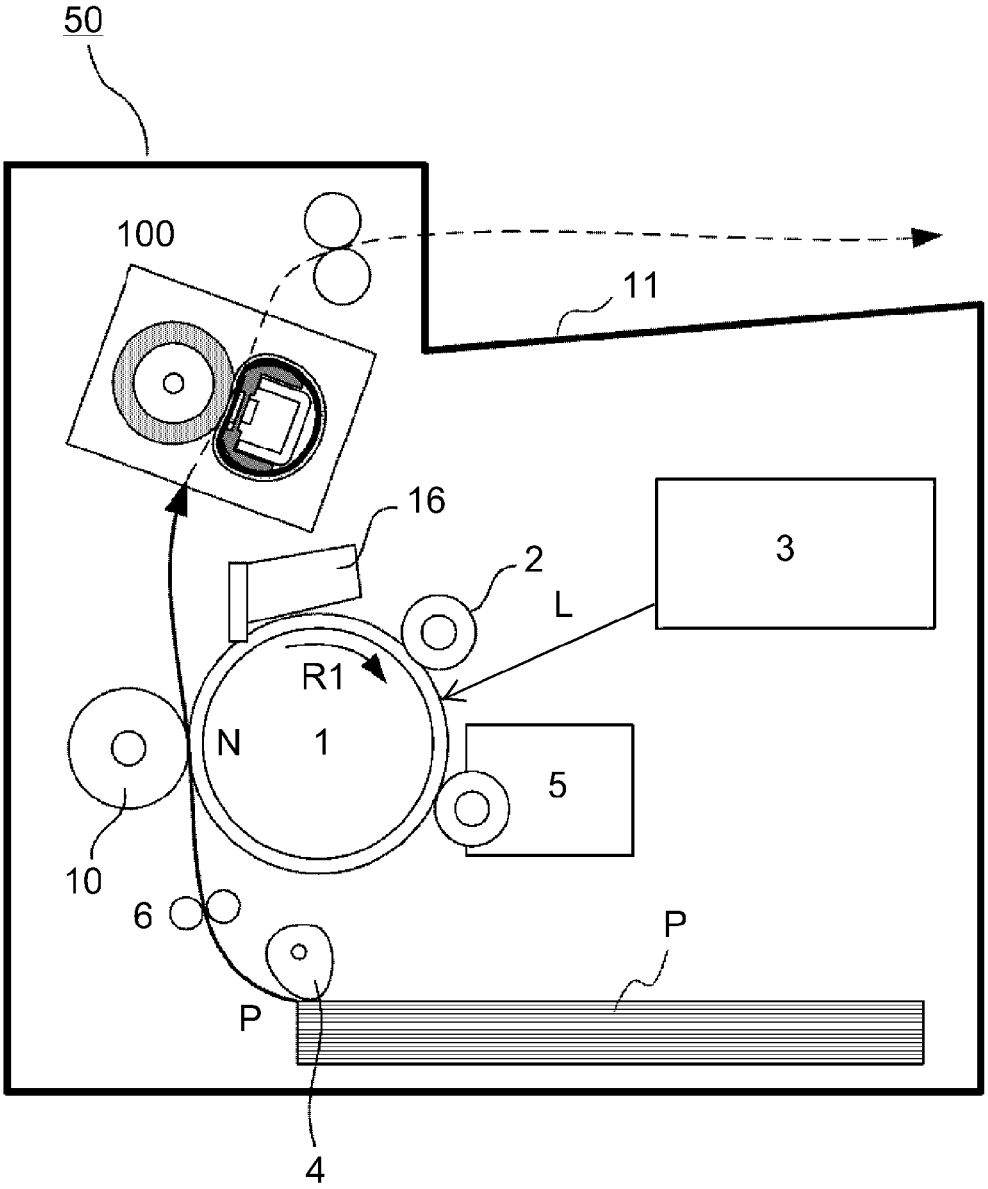
FIG. 2 is a schematic view showing an example of an image forming apparatus.

FIG. 2 is a schematic view of an image forming apparatus 50 in this embodiment. This image forming apparatus 50 is a monochromatic laser (beam) printer of an electrophotographic type in which a toner image, formed on a photosensitive drum 1, which is an image bearing member, is directly transferred onto a sheet-shaped recording material (hereafter referred to as a sheet) P. At a periphery of the photosensitive drum 1, along a drum rotational direction (arrow R1 direction), a charger 2, an exposure device 3 for irradiating the photosensitive drum 1 with laser light L, a developing device 5, a transfer roller 10, and a drum cleaner 16 are provided in a listed order.

A surface of the rotating photosensitive drum 1 is electrically charged to a negative polarity by the charger 2, and the charged surface of the photosensitive drum 1 is subjected to laser scanning exposure by the exposure device 5. The laser light L has been modulated correspondingly to image information, and an electrostatic latent image corresponding to a scanning exposure pattern is formed on the surface of the photosensitive drum 1. At an exposed portion, a surface potential of the photosensitive drum 1 increases. The electrostatic latent image is developed into a toner image by the developing device 5 containing a black toner. The toner in this embodiment is negatively charged, so that the negative toner is deposited on the photosensitive drum 1 only at an electrostatic latent image portion, and thus, the toner image is formed on the photosensitive drum 1.

The sheet P is fed by a feeding roller 4 and is conveyed by a conveying roller pair 6 to a transfer nip N, which is a contact portion between the photosensitive drum 1 and the transfer roller 10. To the transfer roller 10, a transfer bias of a positive polarity, which is an opposite polarity to a charge polarity of the toner, is applied from a power (voltage) source (not shown), so that the toner image is transferred from the photosensitive drum 1 onto the sheet P at the transfer nip N. After the transfer, the photosensitive drum 1 is subjected to removal of a transfer residual toner remaining on the surface thereof by the photosensitive drum cleaner 16 provided with an elastic blade.

The sheet P, on which the toner image is carried, is fed and introduced into a fixing device as an image heating apparatus, and the toner image is heated and fixed on the surface of the sheet P. Then, the sheet P is discharged as an image-formed product onto a tray 11.

Fixing Device

The fixing device 100 in this embodiment is an image heating apparatus (i.e., an on-demand fixing device (OMF)) of a film (belt) heating type for the purpose of shortening of rise time of the fixing device and the purpose of electrical power saving.

Figure 3:
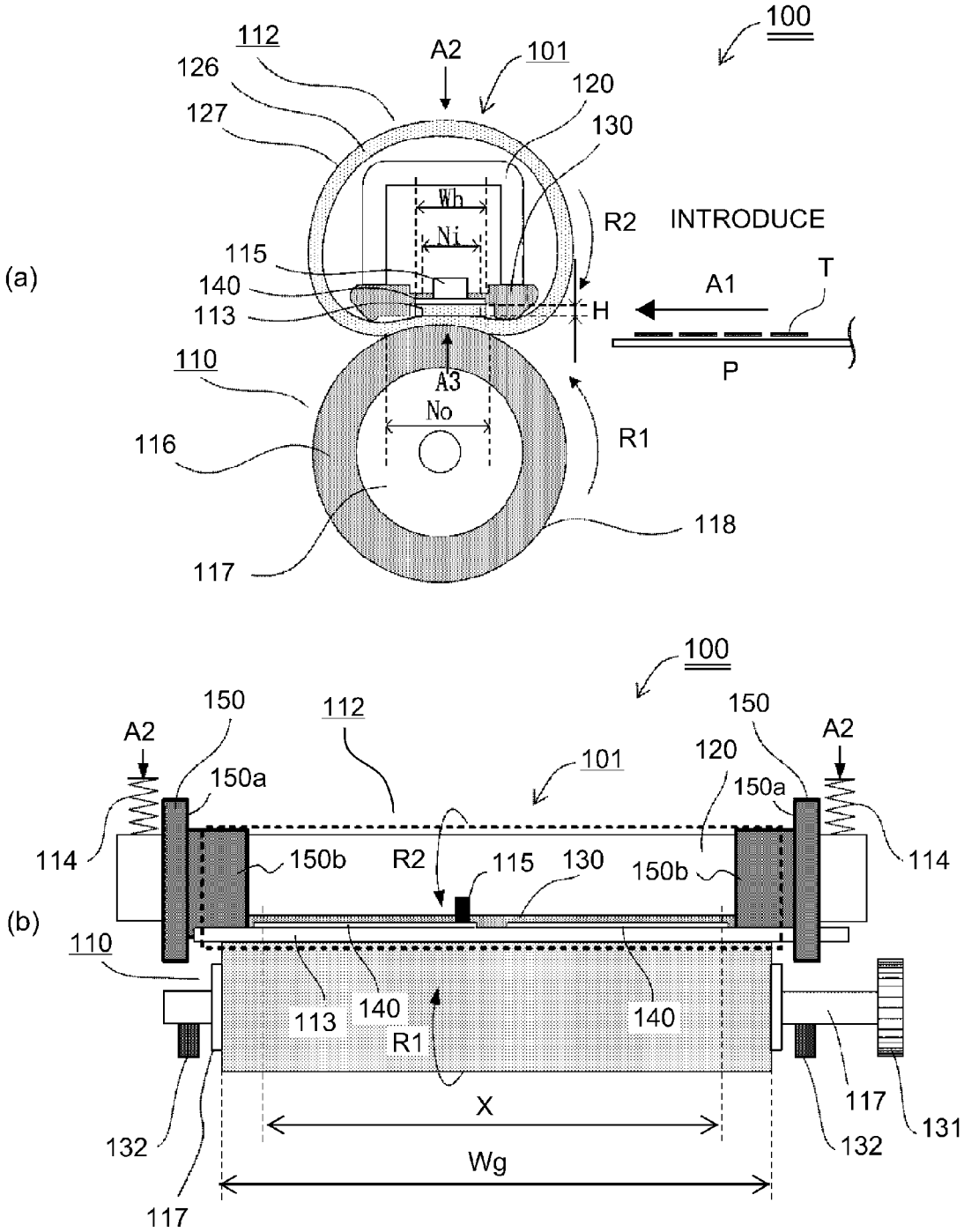
In FIG. 3, parts (a) and (b) are illustrations each showing a principal part of a fixing device.

A sectional view of a principal part of the fixing device 100 in this embodiment is shown in part (a) of FIG. 3. A schematic view of the principal part of the fixing device 100 with respect to a longitudinal direction as seen from an upstream side (sheet introducing side) with respect to a sheet feeding direction (recording material feeding direction, or arrow A1 direction) is shown in part (b) of FIG. 3. In FIG. 3, part (b) shows a see-through state of a fixing film 112 and a heater holder 130 for easy understanding of a heater 113 and a heat-conductive member 140, which are inside members provided inside the fixing film 112.

The fixing device 100 includes a film unit (belt unit) 101 and a pressing roller 100 as an elastic rotatable member (pressing member). The film unit 101 and the pressing roller 110 are provided substantially in parallel with each other, so that a nip (fixing nip) No is formed by the fixing film 112 of the film unit 101 and by the pressing roller 110.

The film unit 101 includes the fixing film 112, which is a rotatable endless belt, loosely fitted around the inside members. Inside the fixing film 112, the heater 113, as a heating member, the heat-conductive member 140, and the heater holder 130, as a holding member (supporting member) for holding (supporting) the heater 113 and the heat-conductive member 140, are disposed. In addition, a temperature detecting element (temperature sensor) 115, a stay 120 for supporting the heater holder 130, and flange members 150 provided in one end side and the other end side are disposed inside the fixing film 112.

The flange members 150 provided in one end side and the other end side are engaged and fixed with the stay 120 in one end side and the other end side, respectively. The fixing film 112 is positioned between flange seats 150*a* of the flange members 150 in one end side and the other end side.

The heater holder 130 is a holding member for holding the heater 113 in a fixed state and may preferably be formed of a low thermal capacity material so that heat of the heater 113 is not readily taken. In this embodiment, a liquid crystal polymer (LCP), which is a heat-resistant resin material, was used. The heater holder 130 is supported by the stay 120 formed of iron, from a side opposite from the heater 113. The heater holder 130 is not necessarily be required to hold the heater 113 in a fixed state, but may also support the heater 113 while being in contact with the heater 113.

A metal core 117 of the pressing roller 110 is rotatably supported by a fixing device casing (not shown) through bearings 132 in one end side and the other end side. The film unit 101 is disposed inside the fixing device casing substantially in parallel with the pressing roller 110 so that the inside heater 113 is disposed opposed to the pressing roller 110. Further, a predetermined pressure is applied to each of the flange members 150 in one end side and the other end side in an arrow A2 direction by pressing springs 114. By this pressure, the stay 120 is pressed and urged in a direction toward the pressing roller 110.

For that reason, a surface (first surface) of the heater 113 held by the heater holder 130 and a part of a surface of the heater holder 130 are press-contacted to the fixing film 112 toward the pressing roller 110 against elasticity of an elastic layer 116 of the pressing roller 110. The (first) surface of the heater 113 contacts an inner surface of the fixing film 112 and forms an inner surface nip Ni in which the fixing film 112 is heated from the inner surface side. Further, the fixing film 112 is press-contacted to the pressing roller 110 so that the heater 113 opposes the pressing roller 110, so that the fixing nip No is formed between an outer surface of the fixing film 112 and the pressing roller 110.

Figure 4:
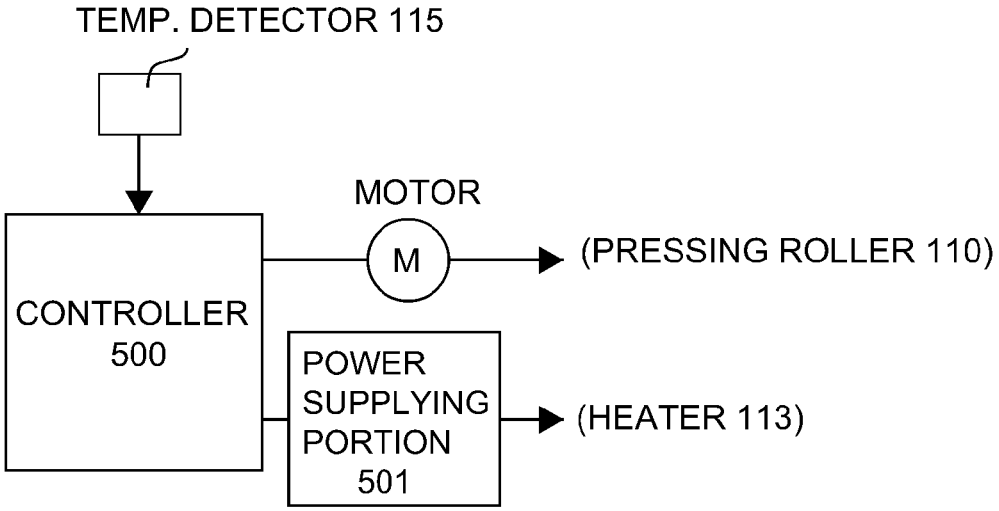
FIG. 4 is a block diagram of a control system.

The pressing roller 110 is rotationally driven at a predetermined speed in the counterclockwise direction, indicated by an arrow R1 direction of part (a) of FIG. 3, by transmitting a driving force of a motor (driving source) M controlled by a controller 500 (FIG. 4) through a power transmitting mechanism (not shown) to a driving gear 131 provided on the metal core 117. In this embodiment, the pressing roller 110 is rotated at a surface movement speed of 200 mm/sec.

With the rotational drive of this pressing roller 110, the fixing film 112 is rotated. That is, the fixing film 112 is rotated by the pressing roller 110 in the clockwise direction indicated by an arrow R2 around the heater 113, the heater holder 130 and the stay 120 while sliding at its inner peripheral surface in contact with a part of the surface of the heater 113 and the surface of the heater holder 130 at the fixing nip No.

Each of the flange seat portions 150*a* of the flange members 150, provided in one end side and the other end side, receives a fixing film end surface and thus, prevents movement of the fixing film 112 in one longitudinal width end direction with rotation of the fixing film 112. Further, film inner surface guiding portions 150*b* of the flange members 150, provided in one end side and the other end side, support the fixing film 112 at end portions, respectively, from an inside of the fixing film 112, and guide the rotating fixing film 112 (determination of rotation locus).

The heater 113 is abruptly heated by heat generation by electrical power supply from an electrical power supplying portion 501 (FIG. 4) controlled by the controller 500, so that a temperature of the heater 113 is detected by the temperature detecting sensor 115. The controller 500 controls, on the basis of temperature information fed back from the temperature detecting sensor 115, electrical power supplied from the electrical power supplying portion 501 to the heater 113, so that the temperature of the heater 113 is increased to a predetermined temperature and is temperature-controlled at the predetermined temperature.

In a state in which the pressing roller 110 is rotationally driven and the heater 113 is increased to and temperature-controlled at the predetermined temperature, the sheet P, on which an unfixed toner image is formed at the image forming portion, is fed and introduced into the fixing nip No in an arrow A1 direction. The sheet P is introduced so that an image surface faces the fixing film 112. Then, the sheet P is nipped and fed at the fixing nip No and thus, is heated and pressed by heat of the fixing film 112 heated by the heater 113 and by a nip pressure, so that the unfixed toner image T is fixed as a fixed image on the sheet P.

In the fixing device in this embodiment, the sheets P having various (large and small) width sizes are passed through the fixing nip No on the basis of a center (line) of an associated sheet width (so-called center (line) basis feeding). In part (b) of FIG. 3, Wg represents a longitudinal width of the elastic layer 116 of the pressing roller 110. Reference numeral X represents a width of a passing region of a maximum-sized sheet (large-sized sheet) usable (feedable) in the fixing device, i.e., a maximum sheet passing width. The longitudinal width Wg of the elastic layer 116 is greater than the maximum sheet passing width X. A longitudinal width of the fixing film 112 is greater than the longitudinal width Wg of the elastic layer 116. Further, the inner surface of the fixing film 112 in one end side and the other end side is supported outside the maximum sheet passing width X by the film inner surface guiding portions 150*b* of the flange members 150 provided in one end side and the other end side, respectively.

Fixing Film

The fixing film 112 in this embodiment is a flexible heat-resistant member having a substantially thin cylindrical shape, and having an outer diameter of 20 mm by its own elasticity in a free state in which an external force is not applied to the fixing film 112 and thus, the fixing film 112 is not deformed. The fixing film 112 has a multi-layer structure with respect to a thickness direction. The layer structure of the fixing film 112 consists of a base layer 126 for maintaining film strength, and a parting layer 127 for lowering a degree of deposition of a contaminant on the surface of the fixing film 112.

A material of the base layer 126 is subjected to heat of the heater 113, and, therefore, is required to have a heat-resistant property. Further, the fixing film 112 slides with the heater 113, and, therefore, is required to have strength. For that reason, it is preferable that a metal material, such as stainless used steel (SUS), or nickel, or a heat-resistant resin material, is used. The metal material has the strength greater than that of the resin material, and, therefore, can be formed in a thin layer, and also has a thermal conductivity greater than that of the resin material, and, therefore, readily conducts heat of the heater 113 to the surface of the fixing film 112. The resin material is small in specific gravity compared with the metal material, and, therefore, has an advantage that a thermal capacity thereof is small and thus, the resin material easily warms. Further, the resin material can be molded in a thin film by coating molding, and, therefore, can be molded inexpensively.

In this embodiment, as a material of the base layer 126 of the fixing film 112, a polyimide resin material was used, and, in order to improve the thermal conductivity and the strength, a carbon-based filler was added and the thus-obtained polyimide resin material was used. The thickness of the base layer 126 more easily conducts the heat of the heater 113 to the fixing film surface with a smaller thickness, but the strength of the base layer 126 lowers, and, therefore, the thickness of the base layer 126 may preferably be about 15 μm to 100 μm. In this embodiment, the thickness of the base layer 126 was 50 μm.

As the material of the parting layer 127 of the fixing film 112, it is preferable that a fluorine-containing resin material such as perfluoroalkoxy resin (PFA), polytetrafluoroethylene resin (PTFE), or tetrafluoroethylene-hexafluoropropylene (FEP) is used. In this embodiment, of the fluorine-containing resin material, PFA, which is excellent in parting property and heat-resistant property, was used.

The parting layer 127 may also be formed by coating the surface of the base layer 126 with a tube or paint. In this embodiment, the parting layer 127 was molded by the coating with the paint excellent in thin layer molding property. The parting layer 127 more easily conducts the heat of the heater 113 to the surface of the fixing film 112 with a smaller thickness, but a durability thereof lowers when the parting layer 127 is excessively thin, and, therefore, may preferably be about 5 μm to 30 μm in thickness. In this embodiment, the thickness of the parting layer 127 was 10 μm.

Pressing Roller

The pressing roller 110 in this embodiment is 20 mm in outer diameter, and, on the metal core 117 formed of iron in a diameter of 12 mm, a 4 mm-thick elastic layer 116 (foamed rubber) formed with a foamed silicone rubber is formed.

When the pressing roller 110 has large thermal capacity and a large thermal conductivity, the heat of the surface of the pressing roller 110 is liable to be absorbed by an inside of the pressing roller 110, so that a surface temperature of the pressing roller 110 is not easily increased. That is, a rise time of the surface temperature of the pressing roller 110 can be shortened when the material having the low thermal capacity, the low thermal conductivity, and a high heat-insulating effect to the possible extent, is used.

The thermal conductivity of the foamed silicone rubber is 0.11 W/m·K to 0.16 W/m·K and is less than about 0.25 W/m·K to 0.29 W/m·K of the solid rubber. Further, a specific gravity relating to the thermal capacity is about 1.05 to 1.30 for the solid rubber, and, on the other hand, is about 0.45 to 0.85 for the foamed silicone rubber, and thus, the foamed silicone rubber also has a low thermal capacity. Accordingly, the foamed silicone rubber can shorten a rise time of the surface temperature of the pressing roller 110.

The thermal capacity can be suppressed when the outer diameter of the pressing roller 110 is small, but, when the outer diameter of the pressing roller 110 is excessively small, a widthwise width (short side width) of the fixing nip No narrows, and, therefore, the pressing roller 110 is required to have a proper diameter. In this embodiment, the outer diameter of the pressing roller 110 was 20 mm. Also, as regards the thickness of the elastic layer 116, when the thickness is excessively thin, the heat dissipates into the metal core 117, and, therefore, the elastic layer 116 is required to have a proper thickness. In this embodiment, the thickness of the elastic layer 116 was 4 mm.

When the pressing roller 110 is heated, the temperature of the elastic layer 116 at longitudinal end portions is liable to lower by heat dissipation from longitudinal end surfaces of the metal core 117 and the elastic layer 116. For that reason, when the longitudinal width Wg of the elastic layer 116 is excessively narrower than the maximum sheet passing width X, a fixing property at the end portions is liable to lower, and, when the longitudinal width Wg is excessively broader than the maximum sheet passing width X, a width of the image forming apparatus becomes large. In this embodiment, the longitudinal width Wg of the elastic layer 116 is set at a value that is greater than a letter size of 216 mm, which is the maximum sheet passing width X, by 5 mm at each of the left and right end portions, i.e., the longitudinal width Wg is set at 226 mm.

On the elastic layer 116, as a toner parting layer, a parting layer 118 of the perfluoroalkoxy resin (PFA) is formed. The parting layer 118 may also be coated with a tube or paint similarly as in the case of the parting layer 127 of the fixing film 112, but in this embodiment, the tube excellent in durability was used.

As the material of the parting layer 118, other than PFA, a fluorine-containing resin material, such as PTFE or FEP, or a fluorine-containing rubber, a silicone rubber, or the like, which are excellent in parting property, may be used. As regards a surface hardness of the pressing roller 110, with a lower surface hardness, a broader fixing nip No with respect to the widthwise width can be obtained by light pressure, but the durability lowers when the surface hardness is excessively low, and, therefore, in this embodiment, the surface hardness as Asker-C hardness (load: 4.9 N) was 40°.

Heater

The heater 113 in this embodiment is a general-purpose heater used in the image heating apparatus of the film heating type. That is, the heater 113 is a ceramic heater including an elongated ceramic substrate and a heat generating resistor, formed on the substrate along a longitudinal direction, for generating heat by electrical power supply (energization).

Figure 1:
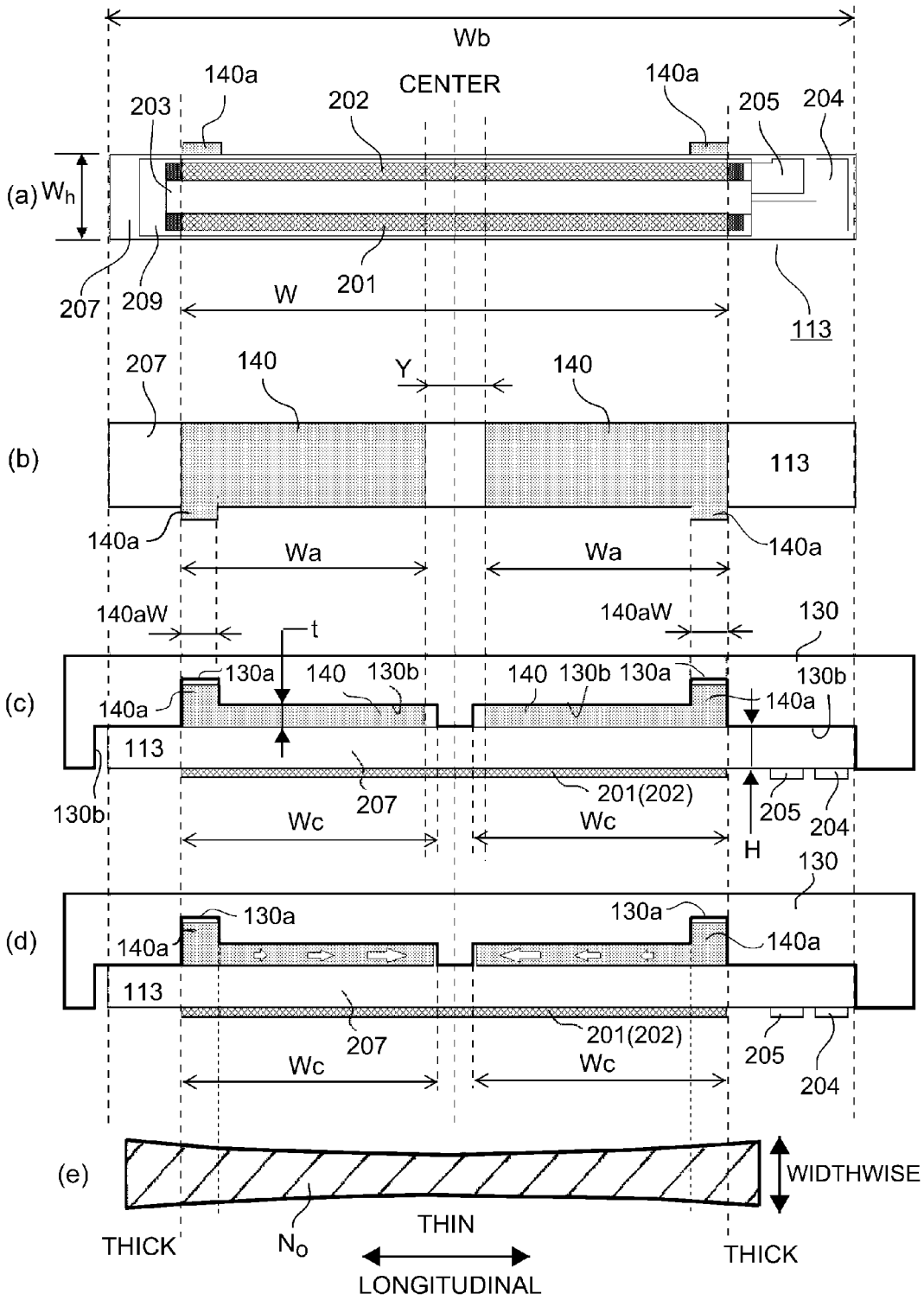
FIG. 1 is an illustration of a structure of a principal part of Embodiment 1.

A structure of the heater 113 in this embodiment will be described with reference to FIGS. 1 and 3. In FIG. 1, part (a) is a schematic view of a surface of the heater 113 as seen in an arrow A3 direction shown in part (a) of FIG. 3.

A substrate 207 of the heater 113 is an alumina substrate of 6 mm in width (widthwise width) Wh (part (a) of FIG. 1) with respect to a sheet feeding direction A1 and 1 mm in thickness H (part (a) of FIG. 3). Two parallel heat generating resistors 201 and 202 are formed on the surface of the substrate 207 along a longitudinal direction of the substrate 207. Each of the heat generating resistors 201 and 202 is formed by coating a 10 μm-thick layer of Ag/Pd (silver/palladium) on the surface of the substrate 207 with a roller width by screen printing. The surfaces of the heat generating resistors 201 and 202 are covered with a 50 μm-thick glass as a heat generating element protecting layer 209. Incidentally, the heat generating element protecting layer 209 is shown in only part (a) of FIG. 1 and is omitted from illustration in parts (c) and (d) of FIG. 1.

In this embodiment, as regards the heater 113, a surface (side) on which the glass layer 209 is formed as the heat generating element protecting layer is an image surface (front surface) (side) on which the inner peripheral surface of the fixing film 112 contacts and slides with the glass layer 209, and a substrate surface (side) opposite from the first surface is a second surface (back surface) (side) on which the heat-conductive member 140 contacts the heater 113 along a longitudinal direction thereof.

When the longitudinal width W of the heat generating resistors 201 and 202 is excessively narrower than the maximum sheet passing width X, a fixing property of the heater 113 at end portions is liable to lower by heat dissipation at end portions of the pressing roller 110. On the other hand, when the longitudinal width W is excessively broader than the maximum sheet passing width X, the temperature in a non-sheet-passing region is liable to rise in a case in which small-sized sheets narrower than large-sized sheets are continuously passed through the fixing nip No. Therefore, when throughput down control, such that the temperature is uniformized by increasing a sheet passing interval so that the non-sheet-passing portion temperature rise does not exceed heat-resistant temperatures of constituent members of the film unit 101 and the pressing roller 110 is effected, productivity lowers.

For that reason, the longitudinal width W of the heat generating resistors 201 and 202 was set at value that is greater than the letter size width of 216 mm corresponding to the maximum sheet passing width X by 1 mm at each of longitudinal end portions of each of the heat generating resistors 201 and 202, i.e., was set at 218 mm.

The two heat generating resistors 201 and 202 are connected with each other via an electroconductive member 203 in one end side and thus, are electrically conducted to each other. The heat generating resistors 201 and 202 are provided with electroconductive electrode portions 204 and 205, respectively, in the other end side. Through these electrode portions 204 and 205, electrical power is supplied to the heat generating resistors 201 and 202, so that the heat generating resistors 201 and 202 generate heat.

A longitudinal width Wb of the substrate 207 of the heater 113 was 270 mm, so that the heat generating resistors 201 and 202, the electroconductive member 203, the electrode portions 204 and 205, and the heat generating element protective layer 209 fall within the region of 270 mm in longitudinal width (length).

As shown in FIG. 3, on the back surface of the heater 113, a temperature detecting element 115 for detecting a temperature of the substrate 207, which was increased in temperature depending on a degree of heat generation of the heat generating resistors 201 and 202, is provided.

Depending on detection temperature information of the temperature detecting element 115, the controller 500 properly controls a current caused to flow from the electrical power supplying portion 501 to the heat generating resistors 201 and 202 through the electrode portions 204 and 205, whereby the temperature of the heater 113 is adjusted.

The temperature detecting element 115 detects the substrate temperature at a heater portion at which sheets having any width, including large and small sheets, have associated sheet passing regions. In this embodiment, the temperature detecting element 115 is contacted the heat-conductive member 140, which is provided on the back surface of the substrate and which is described later, by being inserted into a hole provided in the heater holder 130 toward the back surface of the substrate 207 of the heater 113. That is, the temperature detecting sensor 115 detects the temperature of the heater 113 through the heat-conductive member 140. In order to avoid complicatedness, the temperature detecting element 115 was omitted from the illustration in the figures other than FIG. 3.

Heat-Conductive Member

On the back surface (second surface) of the heater 113, as shown in parts (b) to (d) of FIG. 1, the heat-conductive member 140 for uniformizing the temperature of the heater 113 is provided. The heat-conductive member 140 is a member having thermal conductivity greater than the thermal conductivity of the substrate 207 of the heater 113 with respect to at least a direction parallel to a flat surface thereof.

Figure 5:
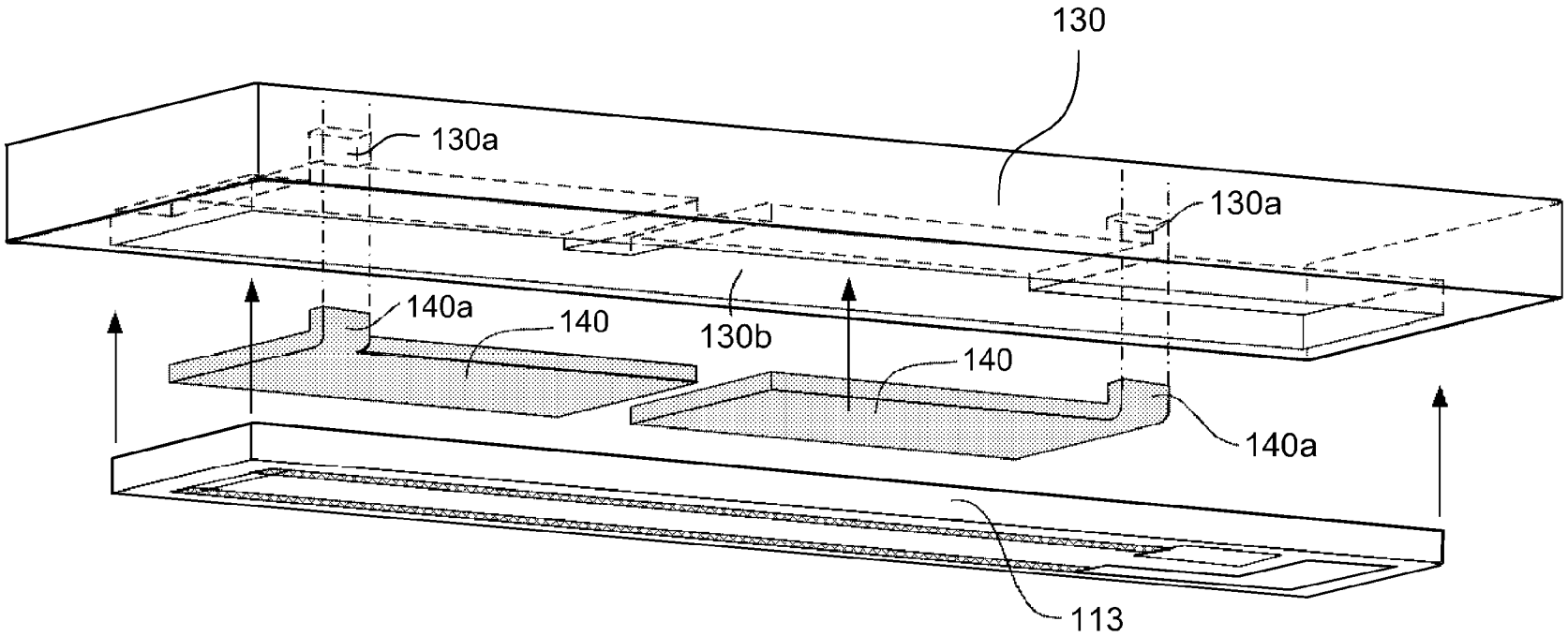
FIG. 5 is a perspective view of general arrangement of a heater holder, a heat-conductive member, and a heater, in which the heat-conductive member and the heater are assembled with the heater holder.

The heat-conductive member 140 is provided and sandwiched between the heater 113 and the heater holder 130. FIG. 5 shows a general arrangement (exploded perspective view) when the heat-conductive member 140 and the heater 113 are assembled with the heater holder 130. The heater holder 130 is provided with a groove 130*b* so that the heat-conductive member 140 and the heater 113 sufficiently fall within the groove 130*b*. As shown, two heat-conductive members 140 are engaged in the groove 130*b* of the heater holder 130, and, thereafter, the heater 113 is engaged in the groove 130*b*.

As regards the material of the heat-conductive member 140, a temperature uniformizing effective on the members, such as the heater 113, the fixing film 112, and the pressing roller 110 is greater when the material has a thermal conductivity greater than thermal conductivity of the material of the substrate 207. The heat-conductive member 140 may be provided by coating silver paste having a high heat conductive property or by contact of a graphite sheet or a metal plate, such as an aluminum plate.

In a case in which the sheet or the metal plate is used as the heat-conductive member 140, there is an advantage that thermal capacity of the heat-conductive member 140 is easily adjusted by a thickness of the sheet or the metal plate. In this embodiment, the plate of aluminum, which is relatively highly heat conductive among metals and which is inexpensive, was used as the heat-conductive member 140. The heat-conductive member 140 has a greater temperature uniformizing effect with a greater thickness, and, therefore, as described above, productivity of the job in which the small-sized sheets narrower than the longitudinal width W of the heat generating resistors 201 and 202 are continuously passed through the fixing nip is improved.

The thermal capacity becomes large, however, and, therefore, the rise time of the heater 113 becomes slow. For that reason, it is desirable that the material and the thickness of the heat-conductive member 140 are adjusted in view of a balance between the productivity of the small-sized sheets during continuous sheet passing and the rise time of the heater 113.

As the heat-conductive member 140 in this embodiment, the aluminum plate having a thickness t of 0.5 mm and a width (widthwise width), with respect to the sheet feeding direction A1, of 6 mm that is equal to the widthwise width Wh of the substrate 207 of the heater 113. Further, alumina as the material of the substrate 207 of the heater 113 and aluminum as the material of the heat-conductive member 140 are different in thermal expansion coefficient, and, therefore, when a heat cycle of heating and cooling is repeated, the heat-conductive member 140 is deformed in some cases. For that reason, the heat-conductive member 140 in this embodiment has a constitution in which the heat-conductive member 140 is divided into two portions with respect to a longitudinal central portion in a feeding region of the sheet P.

As regards the division of the heat-conductive member 140, a longitudinal width of each of the heat-conductive members 140 becomes smaller with an increasing number of divisions with respect to the longitudinal direction, and, therefore, a heat expansion length also becomes smaller, so that the heat-conductive members 140 are not readily deformed. With the increasing number of divisions, however, a heat uniformizing effect on the heater 113 with respect to the longitudinal direction becomes small. Particularly, in order to uniformize a non-sheet-passing portion temperature with respect to the longitudinal direction of the heater 113 when the small-sized sheets are continuously passed through the fixing nip, it is desirable that the heat-conductive members 140 are extended over the non-sheet-passing region and the sheet passing region. In this embodiment, a constitution in which the heat-conductive member 140 was divided into two portions with respect to the longitudinal central portion was employed.

In FIG. 1, part (b) is a schematic view of the heater 113 and the heat-conductive members 140 as seen from the back surface side of the heater 113, i.e., as seen in arrow A2 direction in part (a) of FIG. 3. As shown in part (b) of FIG. 1, the heat-conductive members 140, which are two portions divided with respect to the longitudinal central portion, are separated from each other by a division distance Y. The division distance Y may preferably be small to the possible extent since the heater temperature at a portion (corresponding to a region of the division distance Y) in which there is no heat-conductive member 140 rises when the division distance Y is excessively large, and causes temperature non-uniformity with respect to the longitudinal direction. In this embodiment, the division distance Y was 4 mm.

With an increasing longitudinal width of the heat-conductive member 140, the heat uniformizing effect on the heater 113 with respect to the longitudinal direction is greater, but in a case in which the large-sized sheets having a large size, such as a letter size, are passed through the fixing nip, the heat of the heater 113 at the end portions is liable to dissipate. For that reason, it is desirable that positions of the longitudinal end portions of the heat-conductive member 140 are adjusted in view of a balance between the productivity of the small-sized sheets during the continuous sheet passing and a fixing property of the large-sized sheets with respect to the widthwise direction.

In this embodiment, the longitudinal width (longitudinal end portion positions) of the heat-conductive member 140 was made the same as the longitudinal width W of the heat generating resistors 201 and 202. The longitudinal width W of the heat generating resistors 201 and 202 are 218 mm and the division distance Y of the heat-conductive members 140 is 4 mm, and, therefore, a longitudinal width Wa of each of the divided heat-conductive members 140, positioned in one end side and the other end side, is 107 mm.

Each of the heat-conductive members 140 is provided with a preventing portion 140*a* for preventing positional deviation thereof relative to the heater holder 130 with respect to the longitudinal direction. The preventing portion 140*a* of the heat-conductive member 140 is formed by a bending process, such that a part of the heat-conductive member 140 is bent in a direction of approaching the heater holder 130. On the other hand, the heater holder 130 is provided with a preventing groove 130*a* with which the preventing portion 140*a* of the heat-conductive member 140 is engageable. By engagement of the preventing portion 140*a* of the heat-conductive member 140 with the preventing groove 130*a* of the heater holder 130, the heat-conductive member 140 and the heater holder 130 are prevented from moving in the longitudinal direction.

Fixing Nip Width and Pressure Distribution

The width (widthwise width) of the fixing nip No with respect to the sheet feeding direction A1 and a longitudinal pressure distribution in this embodiment will be described. The fixing nip No in this embodiment is constituted so that the widthwise width is greater at the longitudinal end portions than at the longitudinal central portion. At the end portions of the pressing roller 110, the temperature is liable to lower and, therefore, the fixing property is liable to lower. For that reason, in this embodiment, a constitution in which pressure at the end portions of the pressing roller 110 is made greater than pressure at the longitudinal central portion of the pressing roller 110 and thus, the widthwise width of the fixing nip No at the longitudinal end portions is made greater than the widthwise width of the fixing nip No at the longitudinal central portion is employed. That is, in this embodiment, the fixing nip No includes a region in which the widthwise width gradually increases from the longitudinal central portion toward the longitudinal end portions. Further, the fixing nip No includes a region in which the pressure gradually increases from the longitudinal central portion toward the longitudinal end portions.

Figure 6:
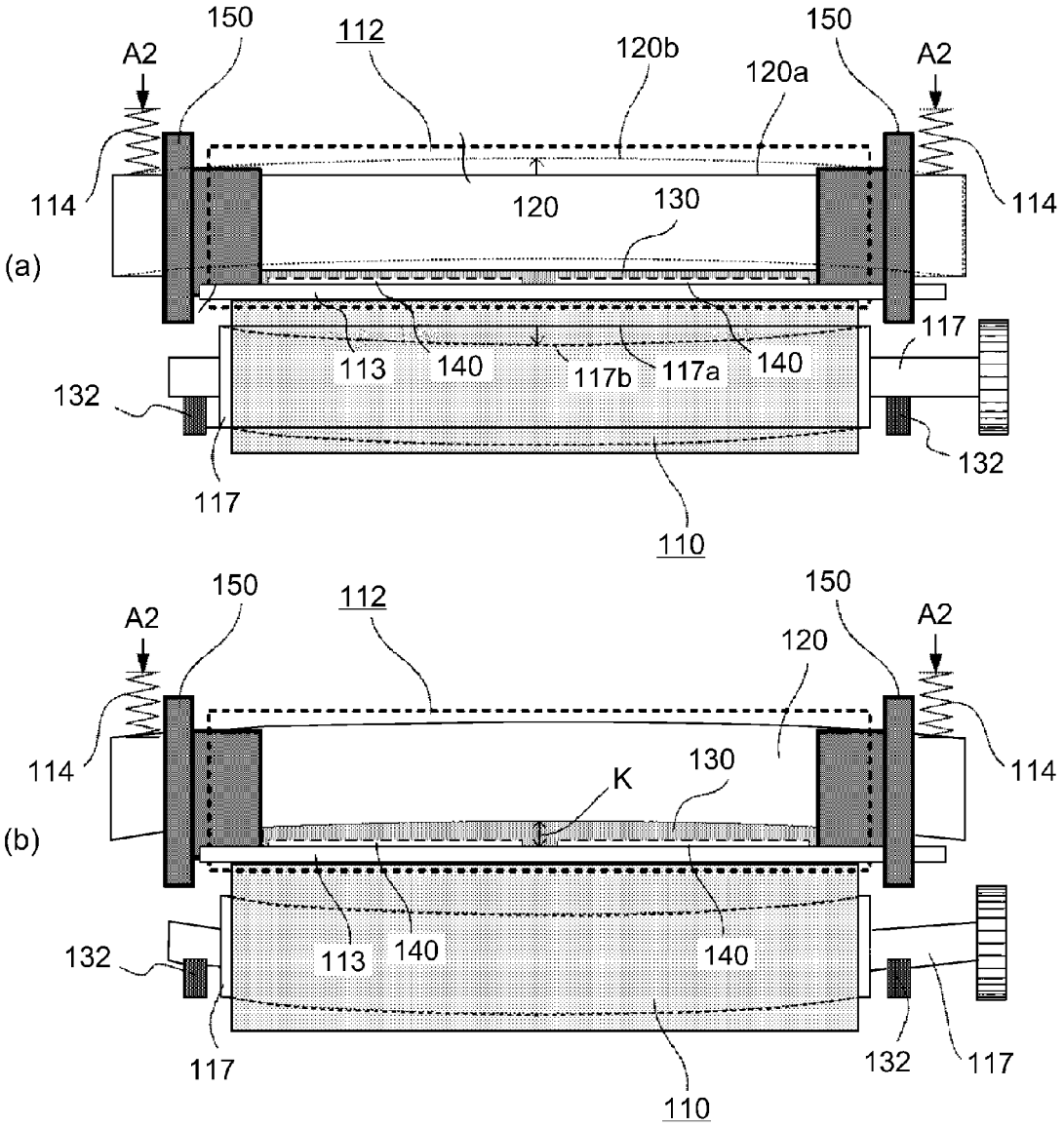
In FIG. 6, parts (a) and (b) are illustrations of fixing nip adjustment.

In FIG. 6, parts (a) and (b) are schematic views each showing flection (bending) of the iron-made stay 120 and the pressing roller 110 with respect to the longitudinal direction by the pressure. As shown in (a) of FIG. 6, the iron-made stay 120 is pressed by the pressing springs 114 at the longitudinal end portions. When the pressing roller 110 receives the pressure by bearings 132 at the longitudinal end portions, the iron-made stay 120 is flexed in a direction from a solid line 120*a* toward a dotted line 120*b*. Further, the metal core 117 of the pressing roller 110 is flexed in a direction from a solid line 117*a* toward a dotted line 117*b*.

When the stay 120 and the pressing roller 110 are flexed, the pressure of the fixing nip No at the longitudinal central portion is decreased and weakened, so that the widthwise width of the fixing nip No in narrower at the longitudinal central portion than at the longitudinal end portions. When the widthwise width of the fixing nip No at the longitudinal central portion becomes narrow, the fixing property at the longitudinal central portion of the fixing nip No lowers, and, therefore, the widthwise width of the fixing nip No is adjusted along the longitudinal direction of the fixing nip No so that the fixing property can be ensured.

In this embodiment, the widthwise width of the fixing nip No along the longitudinal direction was adjusted by the thickness of the heater holder 130. As shown in part (b) of FIG. 6, a thickness K of the heater holder 130 at the longitudinal central portion is made thicker than a thickness of the heater holder 130 at the longitudinal end portions so as to gradually increase from the longitudinal end portions toward the longitudinal central portion (hereafter referred to as a crown correction of the heater holder 130). As a result, the widthwise width of the fixing nip No along the longitudinal direction is adjusted so as not to generate improper fixing at the longitudinal central portion of the fixing nip No.

In this embodiment, as described above, in consideration of the fixing property at the longitudinal end portions of the fixing nip No, the crown correction of the heater holder 130 is made so that the widthwise width of the fixing nip No at the longitudinal end portions is greater than the widthwise width of the fixing nip No at the longitudinal central portion by about 10%. Specifically, a crown correction amount (difference in thickness between the central portion and the end portions of the heater holder) was 400 μm.

Figure 7:
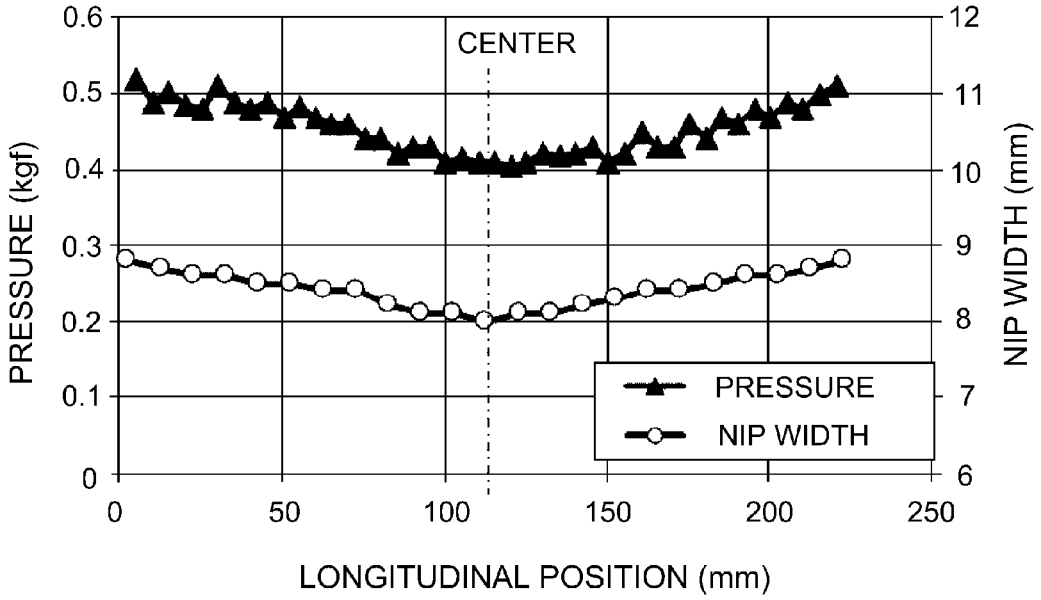
In FIG. 7, parts (a) and (b) are illustrations of a fixing nip of a fixing device in Embodiment 1.
Figure 7:
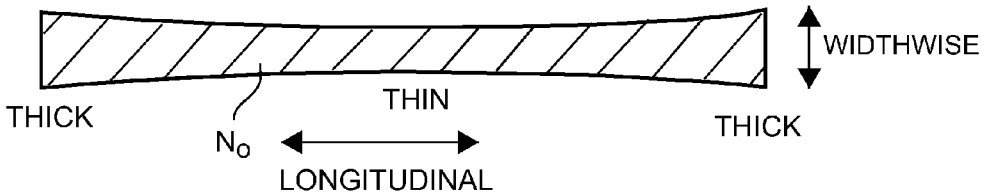

The widthwise width and pressure distribution along the longitudinal direction of the fixing nip No of the fixing device in this embodiment are shown in part (a) of FIG. 7. Here, measurement of the widthwise width of the fixing nip No along the longitudinal direction will be described.

A sheet that has a width broader than 226 mm as the longitudinal width of the elastic layer 116 of the pressing roller 110, and on which a solid black image is printed over an entire width region, is prepared. The sheet is nipped in the fixing nip No, and is heated by the heater 113 in a state in which the drive of the pressing roller 110 is stopped. The temperature of the heater 113 is controlled at 150° by using the temperature detecting element 115, so that the sheet is heated for 10 sec.

The solid black image is heated only at the portion of the fixing nip No, and, therefore, gloss thereof increases, so that a trace (pattern) of the fixing nip No is transferred onto the solid image. From the solid image on which the trace of the fixing nip No is transferred, the widthwise width of the fixing nip No along the longitudinal direction was measured. The widthwise width of the fixing nip No along the longitudinal direction was measured with an interval of 10 mm along the longitudinal direction of the fixing nip No.

Further, the pressure distribution of the fixing nip No along the longitudinal direction was measured using a contact pressure distribution measuring system ("I-SCAN", manufactured by NITTA Corp., longitudinal resolving power: 0.5 mm).

As in a measurement result shown in part (a) of FIG. 7, the widthwise width of the fixing nip No increases from the longitudinal central portion toward the longitudinal end portions with respect to the longitudinal direction of the fixing nip No, and is 8.0 mm at the longitudinal central portion and 8.8 mm at the longitudinal end portions. In FIG. 7, part (b) is a schematic view showing a pattern of the fixing nip No. Also, the pressure distribution of the fixing nip No with respect to the longitudinal direction at this time is, similarly as in the case of the widthwise width of the fixing nip No along the longitudinal direction, such that the pressure of the fixing nip no at the longitudinal central portion is lowest and gradually increases toward the longitudinal end portions. That is, it can be said that the fixing nip pressure is greater with an increasing widthwise width of the fixing nip No.

Position of Preventing Portion of Heat-Conductive Member

A position of the preventing portion 140*a* of the heat-conductive member 140 will be described. In this embodiment, the preventing portion (regulating portion) 140*a* for regulating the longitudinal position of the heat-conductive member 140 is provided at a position corresponding to a region in which the widthwise width of the fixing nip No with respect to the longitudinal direction is large. As a result, a positional deviation of the heat-conductive member 140 with respect to the longitudinal direction is suppressed.

In FIG. 1, part (c) is a schematic longitudinal sectional view showing a state in which the heat-conductive members 140 and the heater 113 are engaged in the heater holder 130. A longitudinal width of each of the engaging groove 130*b* of the heater holder 130 in which the heat-conductive members 140 are engaged is greater than the longitudinal width Wa (107 mm) of the heat-conductive member 140 by 1 mm, so that the heat-conductive member falls within the groove 130*b* even when the heat-conductive member 140 thermally expands, i.e., is 108 mm.

The preventing portions 140*a* for regulating longitudinal positions of the heat-conductive members 140 are provided at positions corresponding to the longitudinal end portions of the fixing nip No, which are regions in which the pressure is high and the widthwise width is broad correspondingly to a schematic view of part (e) of FIG. 1 showing a pattern of the fixing nip No. A longitudinal width 140*a*W of each of the preventing portions 140*a* of the heat-conductive members 140 is 5 mm, and the preventing portions 140*a* are engaged with the preventing (regulating) grooves 130*a*, which are provided in the heater holder 130 side and which have the substantially same width, so that longitudinal positions of the heat-conductive members 140 and the heater holder 130 are regulated.

Figure 14:
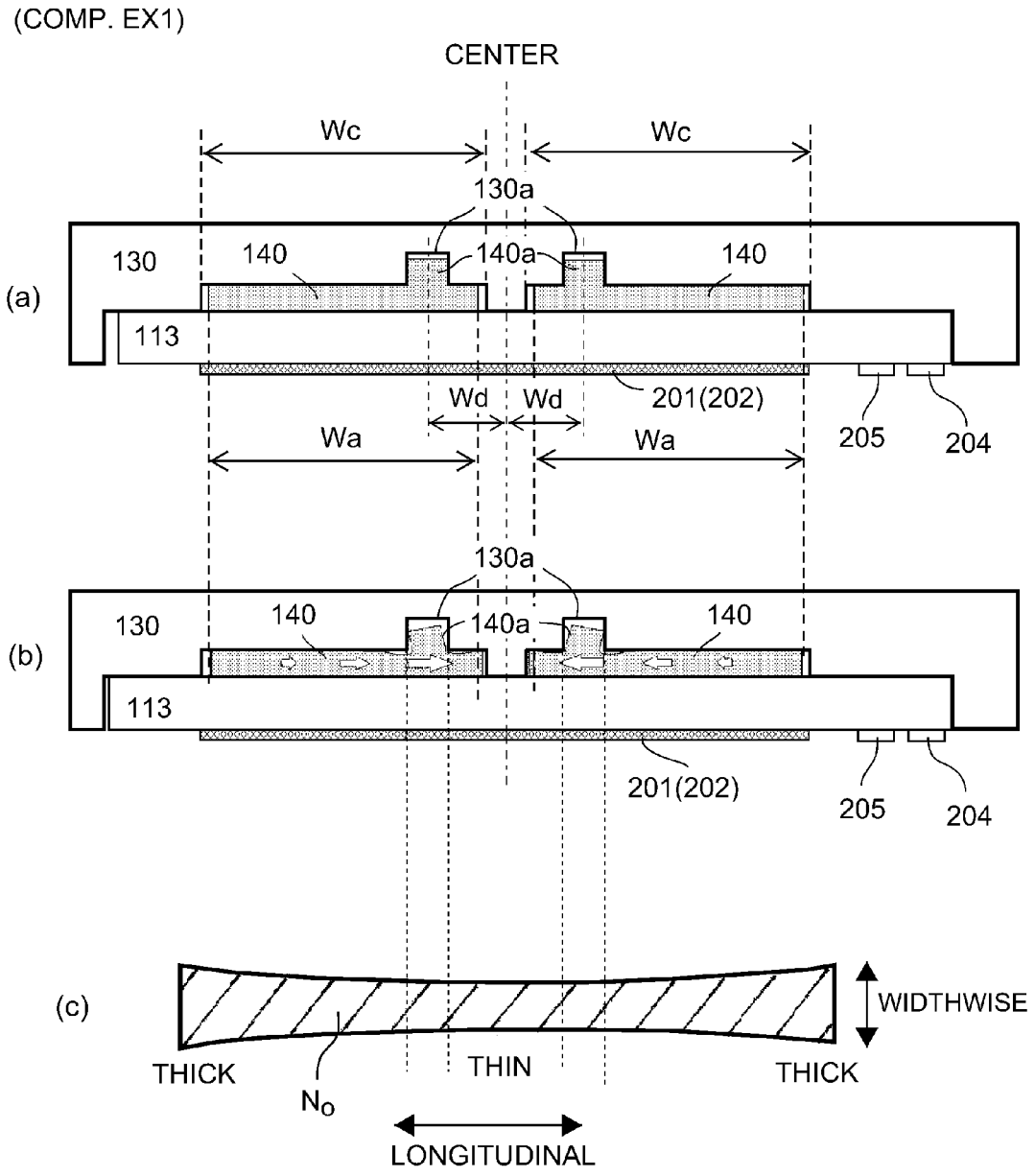
FIG. 14 is an illustration of a principal part of Comparison Example 1.

Here, positions of preventing portions 140*a* of heat-conductive members 140 in Comparison Example 1 will be described. FIG. 14 is a schematic sectional view showing a state in which the heat-conductive members 140 and a heater 113 are engaged in a heater holder 130 in Comparison Example 1. A constitution of Comparison Example 1 is the same as the constitution of this embodiment, except for the longitudinal positions of the preventing portions 140*a* of the heat-conductive members 140 and preventing (regulating) grooves 130*a* of the heater holder 130, and, therefore, constituent members or portions are represented by the same reference numerals or symbols and will be omitted from this description. Further, also the widthwise width of the fixing nip No along the longitudinal direction and the pressure distribution with respect to the longitudinal direction are the same as those in this embodiment, so that the constitution in which the pressure and the widthwise width are less than (smaller) at the longitudinal central portion than at the longitudinal end portions of the fixing nip No (part (c) of FIG. 14).

In FIG. 14, part (a) is a sectional view of the heater 113 before-heating, and part (b) is a sectional view of the heater 113 during the heating. In this Comparison Example 1, the preventing portions 140*a* of the heat-conductive members 140 are provided at positions corresponding to the neighborhood of the longitudinal central portion of the fixing nip No, which is a region in which the pressure is relatively low and the widthwise width is relatively narrow in the fixing nip No.

When the heat-conductive members 140 is thermally expanded by the heating of the heater 113, the heat-conductive members 140 and the heater 113 cause positional deviation with respect to the longitudinal direction due to a thermal expansion difference. In this case, in a place in which the pressure is high with respect to the longitudinal direction of the fixing nip No, a frictional force of the heat-conductive members 140 with the heater holder 130 and the heater 113 is high, and, therefore, the heat-conductive members 140 are not readily positionally deviated, so that the positions of the heat-conductive members 140 are liable to be more deviated at a place in which the pressure is lower.

For that reason, as in the constitution of Comparison Example 1, when the preventing portions 140*a* of the heat-conductive members 140 are provided at portions corresponding to the neighborhood of the longitudinal central portion of the fixing nip No, which is the region of the fixing nip No in which the widthwise width is narrow, the following state is liable to generate. That is, as shown in part (b) of FIG. 14, the heat-conductive members 140 thermally expand toward the longitudinal central portion of the fixing nip No in which the frictional force is small. For that reason, the preventing portions 140*a* of the heat-conductive members 140 are deformed, so that the heat-conductive members 140 are positionally deviated toward the longitudinal central portion of the fixing nip No.

As described above, when the preventing portions 140*a* of the heat-conductive members 140 are deformed, a contact surface of the heat-conductive members 140 with the heater 113 is also deformed in some cases, so that a contact property of the heat-conductive members 140 with the heater 113 lowers in some cases. When the heat-conductive members 140 is spaced from the heater 113 by deformation thereof, the heater 113 becomes high temperature at that portion, so that temperature non-uniformity generates with respect to the longitudinal direction. The longitudinal temperature non-uniformity leads to image defect as uneven gloss on the image in some cases, and can cause heat loss on the heater holder 130 and the pressing roller 110.

On the other hand, the preventing portions 140*a* of the heat-conductive members 140 in this embodiment are positioned, as is apparent from correspondence between parts (c) and (e) of FIG. 1, correspondingly to the longitudinal end portions of the fixing nip No, which are regions in which the pressure is relatively high and the widthwise width of the fixing nip No is relatively broad.

In FIG. 1, part (d) is a sectional view of the heater 113 during the heating. The heat-conductive members 140 are heated by the heater 113, and thermally expand towards the longitudinal central portion of the fixing nip No in which the pressure is low and the widthwise width is narrow (arrow directions in the figure). In this case, the preventing portions 140*a* of the heat-conductive members 140 are provided at portions corresponding to the longitudinal end portions of the fixing nip No, which are regions in which the frictional force of the heat-conductive members 140 with the heater holder 30 and the heater 113 is high. For that reason, the preventing portions 140*a* are not readily positionally deviated and are not readily deformed.

Thus, the preventing portions 140*a* for regulating the longitudinal positions of the heat-conductive members 140 are provided at the positions corresponding to the regions in which the pressure is relatively high with respect to the longitudinal direction of the fixing nip No and the widthwise width of the fixing nip No is broad. By this constitution, the positional deviation and deformation of the heat-conductive members 140 due to repetition of the heat cycle can be suppressed. This effect can be obtained by providing the positions 140*a* in regions of the heat-conductive members 140 corresponding to positions closer to the end portions than to the longitudinal central portion of the fixing nip No.

Verification of Effect

Comparison of generation or non-generation of uneven gloss due to longitudinal temperature non-uniformity with respect to the longitudinal direction of the fixing nip No was made between an arrangement constitution of the heat-conductive members 140 in this embodiment and an arrangement constitution of the heat-conductive members 140 in Comparison Example 1.

The arrangement constitution of the heat-conductive members 140 in this embodiment is the constitution shown in FIG. 1, and is a constitution in which the preventing portions 140*a* are provided at positions corresponding to the longitudinal end portions of the fixing nip No in which the pressure is relatively high with respect to the longitudinal direction of the fixing nip No and the widthwise width is relatively broad.

The arrangement constitution of the heat-conductive members 140 in Comparison Example 1 is the constitution shown in FIG. 14, and is a constitution in which the preventing portions 140*a* are provided at positions corresponding to the neighborhood of the longitudinal central portion of the fixing nip No in which the pressure is relatively low with respect to the longitudinal direction of the fixing nip No and the widthwise width is relatively narrow. In Comparison Example 1, a longitudinal center position of each of the preventing portions 140*a* is spaced from a pressure center by 10 mm in a leftward or rightward direction (Wd in (a) of FIG. 14: 10 mm).

As regards a print image, when a uniform pattern is printed on an entire surface, uneven gloss is liable to be in sight, and particularly, when a solid image having a large toner deposition amount is printed, the uneven gloss is liable to generate. The heater 113 was actuated from a cold state that the fixing device 100 is cool, and a whole surface solid image on which the uneven gloss was liable to be in sight and a whole surface halftone image on which the uneven gloss was not readily relatively in sight and which has a print ratio of 59% were printed on 2 sheets in total, and then generation or non-generation of the uneven gloss on the image was checked.

After the printing, the fixing device 100 is cooled and placed in the cold state, and then the whole surface solid image and the whole surface halftone image with the print ratio of 50% are printed again on 2 sheets in total. This 2 sheet-intermittent printing was repeated 50,000 times when a total print number reached 100,000 sheets, which was a lifetime of the fixing device 100, so that each of the whole surface solid image and the whole surface halftone image were printed on 50,000 sheets, i.e., 100,000 sheets in total, and then generation or non-generation of the uneven gloss on the image was checked.

In the arrangement constitution of the heat-conductive members 140 in Comparison Example 1, the uneven gloss generated on the solid image after 30,000 heat cycles and later, so that the positional deviation and deformation of the heat-conductive members 140 with respect to the longitudinal direction were confirmed. Further, after 40,000 heat cycles and later, the uneven gloss was confirmed also on the halftone image, and a deformation amount of the heat-conductive members 140 also became large.

On the other hand, in the arrangement constitution of the heat-conductive members 140 in Embodiment 1, at the time of 50,000 heat cycles, the uneven gloss did not generate even on the solid image, and the positional deviation and the deformation of the heat-conductive members 140 with respect to the longitudinal direction were not confirmed.

Thus, according to the arrangement constitution of the heat-conductive members 140 in Embodiment 1, it is possible to suppress the positional deviation and the deformation of the heat-conductive members 140 with respect to the longitudinal direction generated due to repetition of the heat cycle. Further, it is possible to prevent image defect due to the uneven gloss and breakage of the constituent members.

Embodiment 2

Embodiment 2 will be described. In this embodiment, contrary to Embodiment 1, in a constitution in which the widthwise width of the fixing nip No is broader at the longitudinal central portion than at the longitudinal end portions of the fixing nip No, the longitudinal positional deviation of the heat-conductive members 140 and the deformation of the preventing portions 140*a* are suppressed. By providing the preventing portions 140*a* of the heat-conductive members 140 at positions corresponding to the neighborhood of the longitudinal central portion of the fixing nip No in which the widthwise width is broad, the longitudinal positional deviation of the heat-conductive members 140 and the deformation of the preventing portions 140*a* are suppressed, so that the image defect due to the uneven gloss and breakage of the fixing member are prevented. This will be described below.

In this embodiment, as regards the image forming apparatus for forming the unfixed toner image, the image forming apparatus is similar to that in Embodiment 1 described above and is a general-purpose image forming apparatus, and, therefore, will be omitted from redundant description. Further, the fixing device 100, which is the image heating apparatus, is an image heating apparatus of the film heating type similarly as in Embodiment 1 in basic structure, and, therefore, members or portions that are the same as those in Embodiment 1 are represented by the same reference numerals or symbols and will be omitted from redundant description.

In a case in which a foam rubber is used as the elastic layer 116 of the pressing roller 110, paper creases are prevented by making the widthwise width of the fixing nip No greater at the longitudinal central portion than at the longitudinal end portions in some cases. The foam rubber is deflated when crushed at the fixing nip No, so that the fixing nip surface approaches the core metal 117, and, therefore, a rotation radius of the fixing nip No in which the sheet P is fed becomes small. For that reason, a feeding speed of the sheet P becomes slower at a portion in which the pressure of the fixing nip No with respect to the longitudinal direction is greater and a crush amount of the elastic layer 116 is greater (i.e., a portion in which the widthwise width of the fixing nip No is broader).

In order to prevent the paper creases, it has been generally known that it is preferable that the feeding speed of the sheet P is made greater at the longitudinal end portions than at the longitudinal central portion of the fixing nip No. For that reason, a constitution in which the elastic layer 116 is more crushed at the longitudinal central portion than at the longitudinal end portions of the fixing nip No, i.e., a constitution in which the widthwise width of the fixing nip No is made broader at the longitudinal central portion than at the longitudinal end portions of the fixing nip No. As a result, the feeding speed of the sheet P at the longitudinal end portions of the fixing nip No is greater than the feeding speed of the sheet P at the longitudinal central portion of the fixing nip No, so that the paper creases can be prevented.

In this embodiment, similarly as in Embodiment 1 with reference to FIG. 6, by the crown correction of the heater holder 130, setting of the widthwise width of the fixing nip No was made so that the widthwise width at the longitudinal central portion was greater than the widthwise width at the longitudinal end portions.

In the fixing device 100 in this embodiment, the crown correction of the heater holder 130 is made so that the widthwise width of the fixing nip No at the longitudinal central portion is greater than the widthwise width of the fixing nip No at the longitudinal end portions by about 10%. Specifically, a crown correction amount (difference in thickness between the central portion and the end portions of the heater holder) was 600 μm.

Figure 8:
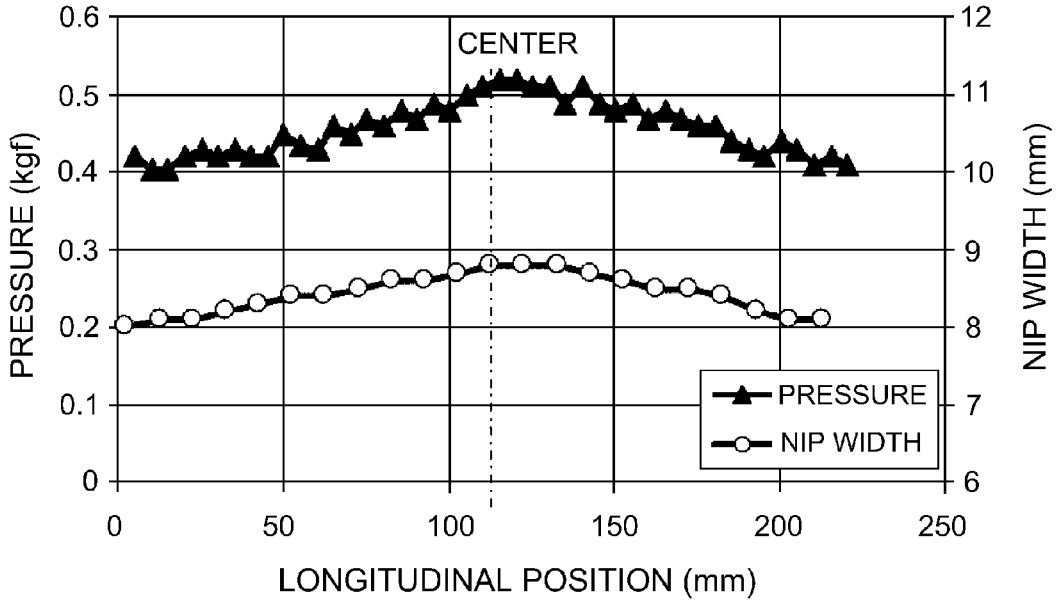
In FIG. 8, parts (a) and (b) are illustrations of a fixing nip of a fixing device in Embodiment 2.
Figure 8:
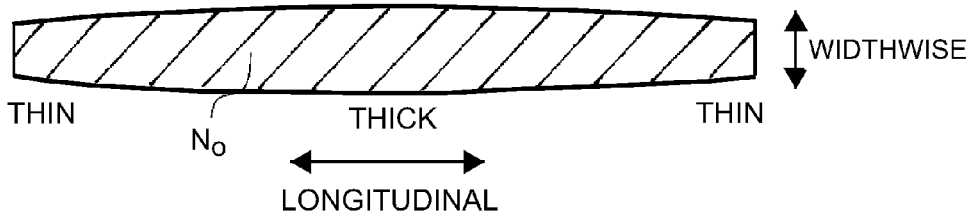

The widthwise width and pressure distribution along the longitudinal direction of the fixing nip No of the fixing device 100 in this embodiment are shown in part (a) of FIG. 8. The widthwise width and the pressure distribution along the longitudinal direction of the fixing nip No were measured by methods similar to those in Embodiment 1.

As in a measurement result shown in part (a) of FIG. 8, there is a region in which the widthwise width of the fixing nip No along the longitudinal direction increases from the longitudinal end portions toward the longitudinal central portion, and is 8.8 mm at the longitudinal central portion and 8.0 mm at the longitudinal end portions. In FIG. 8, part (b) is a schematic view showing a pattern of the fixing nip No. Also the pressure distribution of the fixing nip No along the longitudinal direction at this time is, similarly as in the case of the widthwise width of the fixing nip No along the longitudinal direction, such that there is a region in which the pressure of the fixing nip No at the longitudinal central portion is highest and gradually decreases toward the longitudinal end portions. That is, the pressure of the fixing nip No is greater with an increasing widthwise width of the fixing nip No.

Position of Preventing Portion of Heat-Conductive Member

Also, in this embodiment, the preventing portion (regulating portion) 140*a* for regulating the longitudinal position of the heat-conductive member 140 is provided at a position corresponding to a region in which the widthwise width of the fixing nip No with respect to the longitudinal direction is large. As a result, a positional deviation of the heat-conductive member 140 with respect to the longitudinal direction is suppressed.

Figure 9:
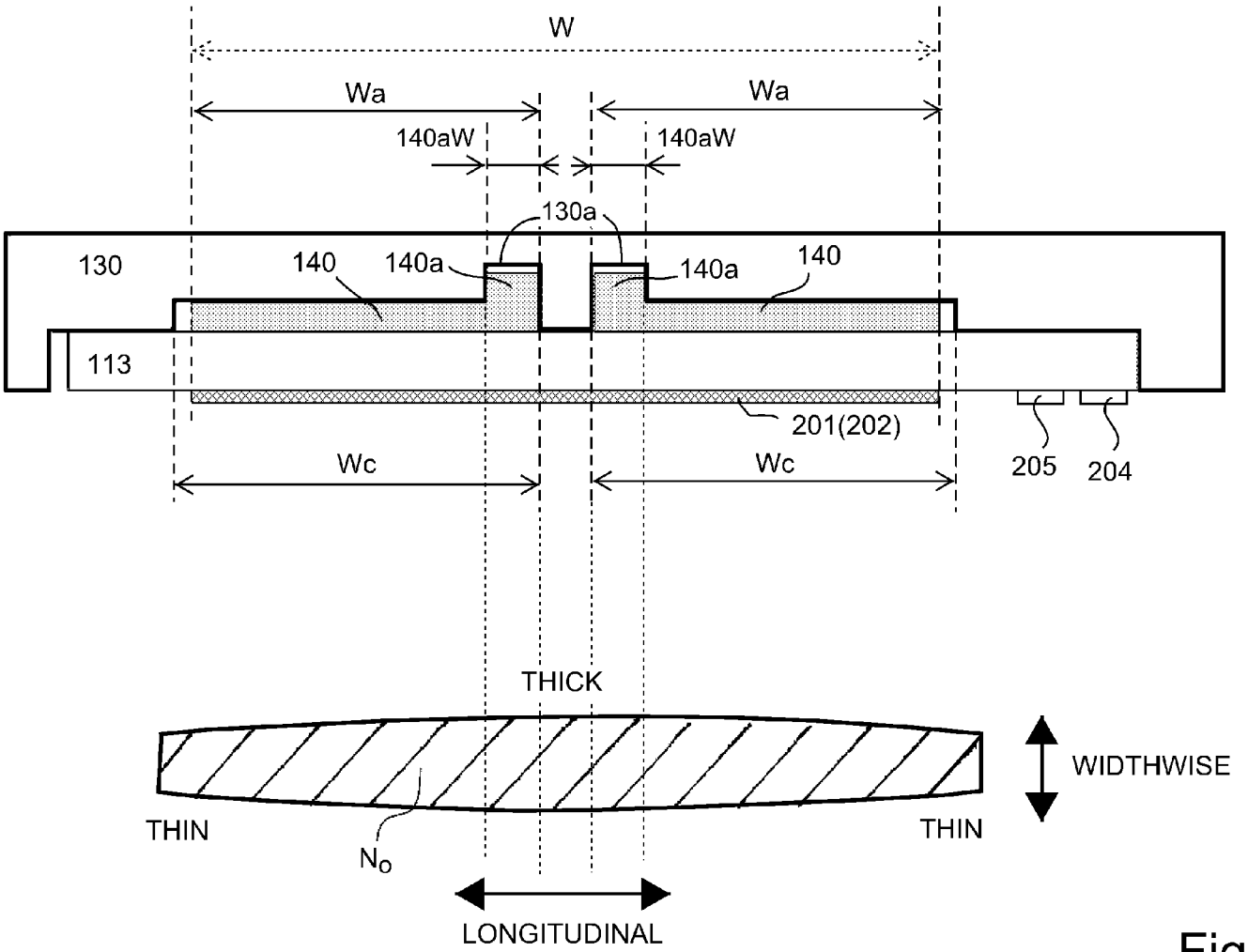
FIG. 9 is an illustration of a principal part of the fixing device in Embodiment 2.

FIG. 9 shows positions of the preventing portions 140*a* of the heat-conductive members 140 in this embodiment. Also the heat-conductive members 140 in this embodiment has a constitution in which the heat-conductive member is divided into the two heat-conductive members 140 correspondingly to prevention of the deformation due to the heat cycle similarly as in Embodiment 1. The preventing portions 140*a* of the heat-conductive members 140 in this embodiment are provided at positions corresponding to the neighborhood of the central portion, of the longitudinal portions of the fixing nip No, in which the pressure is relatively high and the widthwise width is relatively broad.

As in this embodiment, in the case in which the pressure is greater and the widthwise width is broader at the longitudinal central portion than at the longitudinal end portions of the fixing nip No, the frictional force of the heat-conductive members 140 with the heater holder 130 and the heater 113 is greater at the longitudinal central portion than at the longitudinal end portions. For that reason, the heat-conductive members 140 heated by the heater 113 thermally expand toward the longitudinal end portions of the fixing nip No in which the pressure is low and the widthwise width is narrow.

Also in this embodiment, the preventing portions 140*a* of the heat-conductive members 140 are provided in the neighborhood of the longitudinal central portion of the fixing nip No in which the frictional force is large, and, therefore, even when the heat cycle is repeated, the positions of the preventing portions 140*a* are not deviated and the preventing portions 140*a* are not deformed.

Also in the constitution in this embodiment, similarly as in Embodiment 1, the generation or non-generation of the uneven gloss was checked, but there was no generation of the uneven gloss even on the solid image until the total print number reaches the lifetime of the fixing device, and the longitudinal positional deviation and the longitudinal deformation of the heat-conductive members 140 were not confirmed.

Also in the constitution in which the pressure is greater and the widthwise width is broader at the longitudinal central portion than at the longitudinal end portions of the fixing nip No as in this embodiment, an effect similar to that in Embodiment 1 can be obtained by providing the preventing portions 140*a* of the heat-conductive members 140 at the positions corresponding to the regions in which the widthwise width is broad. That is, it is possible to suppress the longitudinal positional deviation and the longitudinal deformation of the heat-conductive members 140 generated due to the repetition of the heat cycle.

Embodiment 3

In Embodiments 1 and 2, the constitution in which the heat-conductive member was divided into the two heat-conductive members 140 at the longitudinal central portion was described, but the present invention is not limited thereto. In this embodiment, in a constitution in which a heat-conductive member 140 is not divided with respect to the longitudinal direction, the longitudinal positional deviation of the heat-conductive members 140 and the deformation of the preventing portions 140*a* are suppressed. This will be described below.

In this embodiment, as regards the image forming apparatus 50 for forming the unfixed toner image, the image forming apparatus is similar to that in Embodiment 1 described above and is a general-purpose image forming apparatus, and, therefore, will be omitted from redundant description. Further, also the fixing device 100 is an image heating apparatus of the film heating type similarly as in Embodiment 1 in basic structure, and, therefore, members or portions that are the same as those in Embodiment 1 are represented by the same reference numerals or symbols and will be omitted from redundant description. Further, similarly as in Embodiment 2, the constitution in which the paper creases are prevented by making the widthwise width of the fixing nip No greater at the longitudinal central portion than at the longitudinal end portions is employed. The crown correction amount of the heater holder 130 is 600 μm similarly as in Embodiment 2, and also the widthwise width and the pressure distribution along the longitudinal direction of the fixing nip No are the same as those in Embodiment 2 as shown in FIG. 8.

Position of Preventing Portion of Heat-Conductive Member

Figure 10:
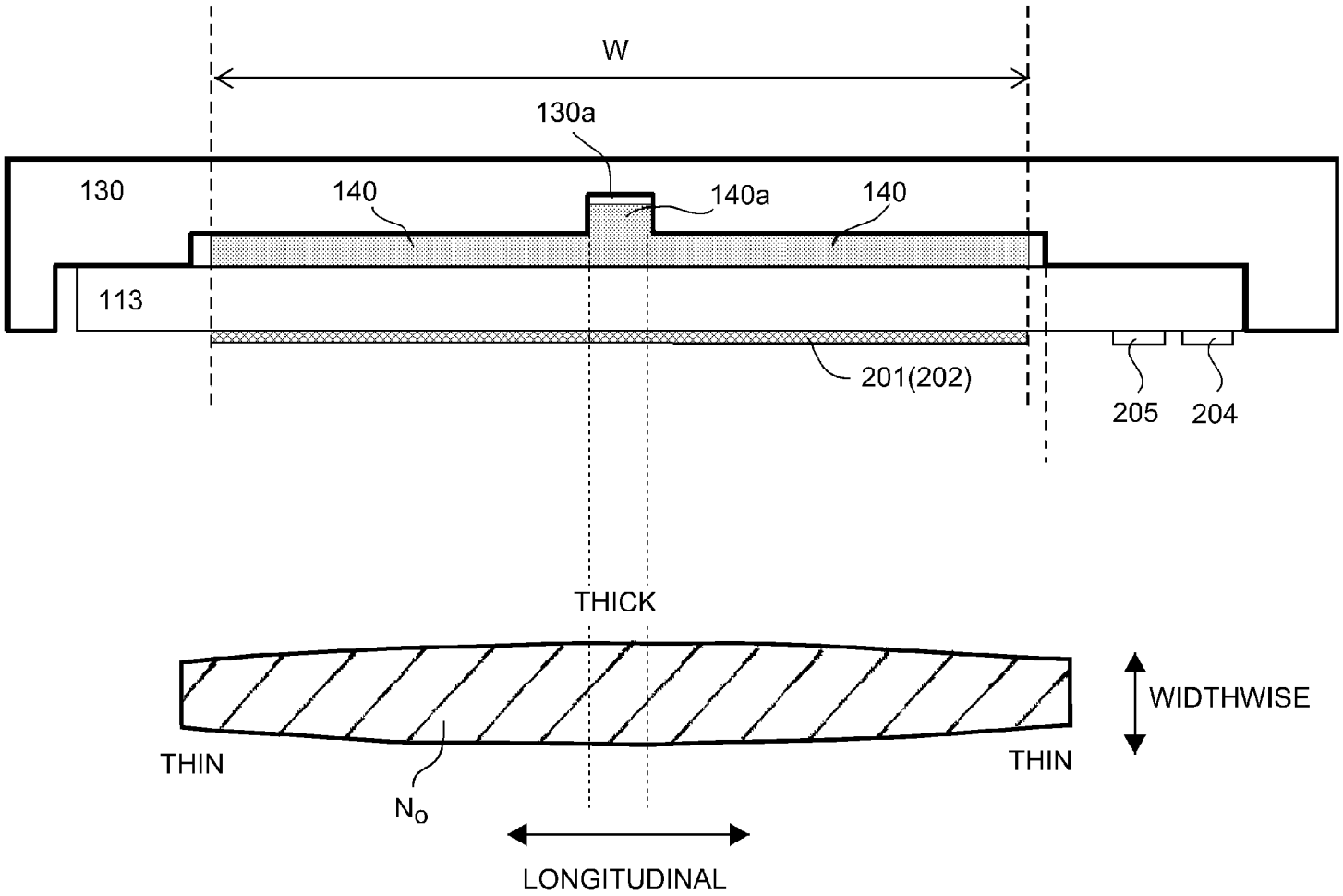
FIG. 10 is an illustration of a principal part of a fixing device in Embodiment 3.

In the constitution in this embodiment, a single heat-conductive member 140 is used and a preventing portion 140*a* for regulating the longitudinal position of the heat-conductive member 140 is provided at a position substantially corresponding to the longitudinal central portion of the fixing nip No in which the widthwise width of the fixing nip No with respect to the longitudinal direction of the heat-conductive member 140 is large. FIG. 10 shows position of the preventing portion 140*a* of the heat-conductive members 140 in this embodiment. The preventing portion 140*a* of the heat-conductive member 140 in this embodiment is provided at a position corresponding to the longitudinal central portion, of the longitudinal portions of the fixing nip No, in which the pressure is relatively high and the widthwise width is relatively broad.

Similarly as in Embodiment 2, in the case in which the pressure is greater and the widthwise width is broader at the longitudinal central portion than at the longitudinal end portions of the fixing nip No, the frictional force of the heat-conductive member 140 with the heater holder 130 and the heater 113 is greater at the longitudinal central portion than at the longitudinal end portions of the fixing nip No. For that reason, the heat-conductive members 140 heated by the heater 113 thermally expand toward the longitudinal end portions of the fixing nip No in which the pressure is low and the widthwise width is narrow.

Also in this embodiment, the preventing portion 140*a* of the heat-conductive member 140 is provided at the position corresponding to the longitudinal central portion of the fixing nip No in which the frictional force is large, and, therefore, even when the heat cycle is repeated, the position of the preventing portion 140*a* is not deviated and the preventing portion 140*a* is not deformed.

Also, in the constitution in which the single heat-conductive member 140 is used is employed as in the constitution in this embodiment, the preventing portion 140*a* for regulating the longitudinal position of the heat-conductive member 140 is provided in the region, of the longitudinal regions of the fixing nip No, in which the pressure is relatively high and the widthwise width is relatively broad. As a result, it is possible to suppress the longitudinal positional deviation and the longitudinal deformation of the heat-conductive members 140 generated due to the repetition of the heat cycle.

OTHER EMBODIMENTS (1) In Embodiments 1 to 3, the preventing portion 140*a* for regulating the longitudinal position of the heat-conductive member 140 is provided at the position corresponding to the region, of the longitudinal regions of the fixing nip No, in which the pressure is relatively high and the widthwise width is relatively broad. As a result, the longitudinal positional deviation and the deformation of the heat-conductive member 140 generated due to the heat cycle are suppressed. Such a constitution was described.

Correspondingly thereto, when the preventing portion 140*a* of the heat-conductive member 140 extends over the non-sheet-passing region that is outside the maximum sheet passing width X in which the sheet P is feedable and temperature rises, it is possible to further suppress the longitudinal positional deviation of the heat-conductive member 140. This will be described below.

In Embodiments 1 to 3, the constitution in which the foam rubber was used as the elastic layer 116 of the pressing roller 110 in the fixing device 100 of the monochromatic image forming apparatus 50 for which importance is placed on actuation (rising) of the fixing device 100 was described. In a fixing device used with a color image forming apparatus, a solid rubber is used as the elastic layer 116 of the pressing roller 110 in some cases.

In the color image forming apparatus, in addition to the black toner, three toners of yellow, magenta, and cyan, i.e., the four color toners in total are used for printing (image formation), and, therefore, the toner deposition amount is large. In a case in which the toner amount is large, in some instances, the pressing roller 110 is required to have a large thermal capacity in order to add the heat to an interface between the sheet P and the toner and to fix the toner images. For that reason, in the fixing device of the color image forming apparatus, as the elastic layer 116 of the pressing roller 110, the solid rubber, not the foam rubber is frequently used.

The pressing roller 110 of the solid rubber is greater in thermal capacity and thermal conductivity than that of the foam rubber, and, therefore, a rising speed of the surface temperature becomes slow, but a heat uniformizing effect with respect to the longitudinal direction is achieved. The solid rubber has high thermal conductivity and, therefore, heat is easily conducted to the metal core 117 compared with the foam rubber, and also heat at the end portions easily dissipates and, therefore, the temperature of the pressing roller 110 at the end portions is liable to lower. For that reason, in in which the solid rubber is used as the elastic layer 116 of the pressing roller 110, the longitudinal width W of the heat generating resistors 201 and 202 of the heater 113 is set so as to be sufficiently broader than the maximum sheet passing width X as shown in FIG. 11 in some instances.

In this case, when the large-sized sheets having a width corresponding to the maximum sheet passing width X are continuously passed through the fixing nip, the pressing roller temperature in the non-sheet-passing region increases. When the pressing roller 110 increases in temperature, the pressure at the temperature-increased portion increases due to thermal expansion. For that reason, in the non-sheet-passing region, the frictional force of the heat-conductive members 140 with the heater holder 130 and the heater 113 increases.

As in the constitution in Embodiment 1, in a case in which the pressure is greater and the widthwise width of the fixing nip No is broader at the longitudinal end portions than at the longitudinal central portion of the fixing nip No, the preventing portions 140*a* of the heat-conductive members 140 are provided at the positions corresponding to the longitudinal end portions of the fixing nip No. Based on this constitution, it was described that the heat-conductive members 140 were not readily positionally deviated.

Figure 11:
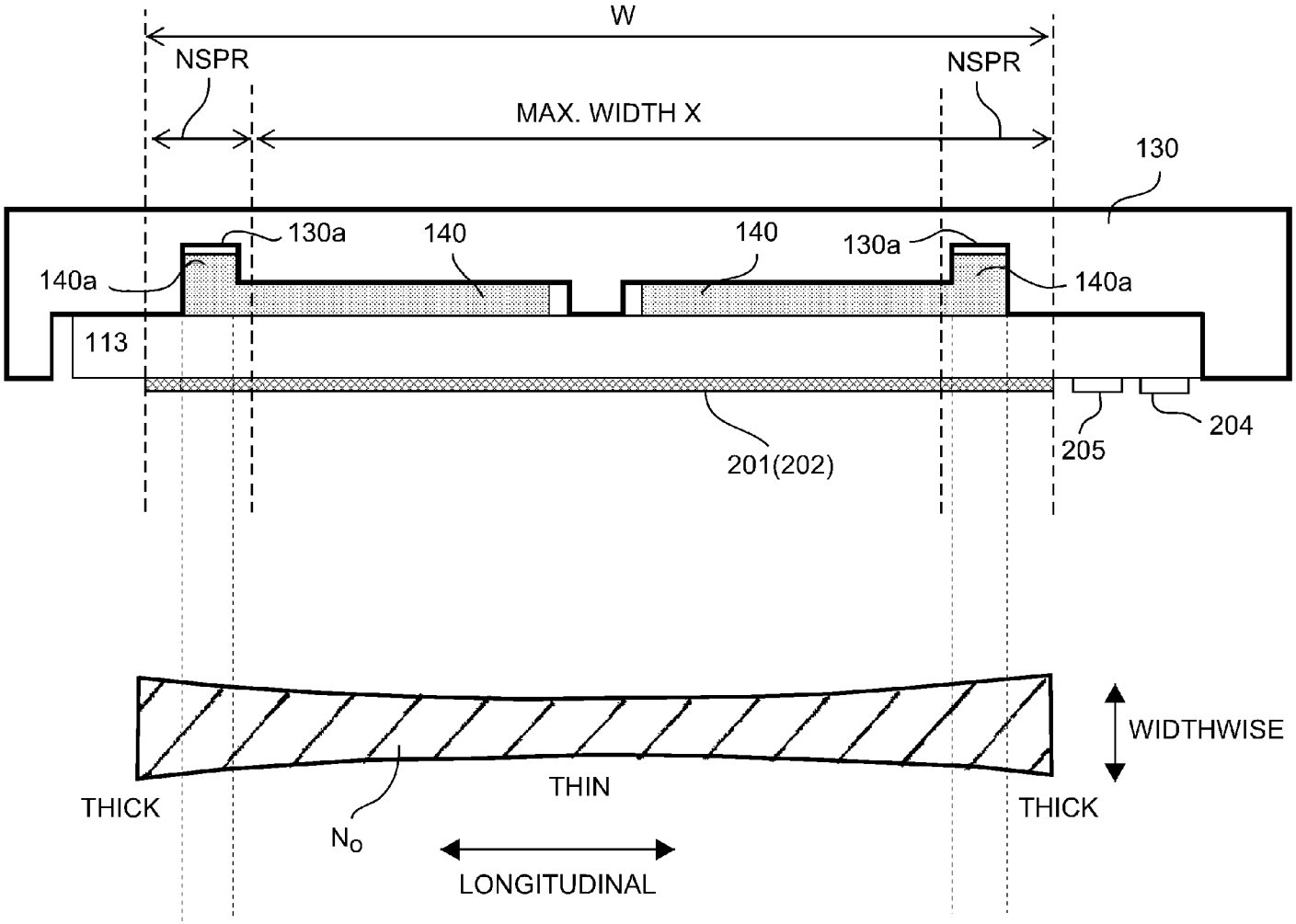
FIG. 11 is an illustration of a principal part of another embodiment.

In addition to the constitution of Embodiment 1 in which the widthwise width of the fixing nip No is broader at the longitudinal end portions than at the longitudinal central portion of the fixing nip No, as shown in FIG. 11, the preventing portions 140*a* of the heat-conductive members 140 are provided in the non-sheet-passing regions positioned outside the maximum sheet passing width X. That is, each of the preventing portions 140*a* is disposed outside the passing region of the maximum width-sized sheets that are feedable in the longitudinal direction of the fixing nip No by the fixing device. As a result, the longitudinal positional deviation of the heat-conductive members 140 can be further suppressed.

Figure 12:
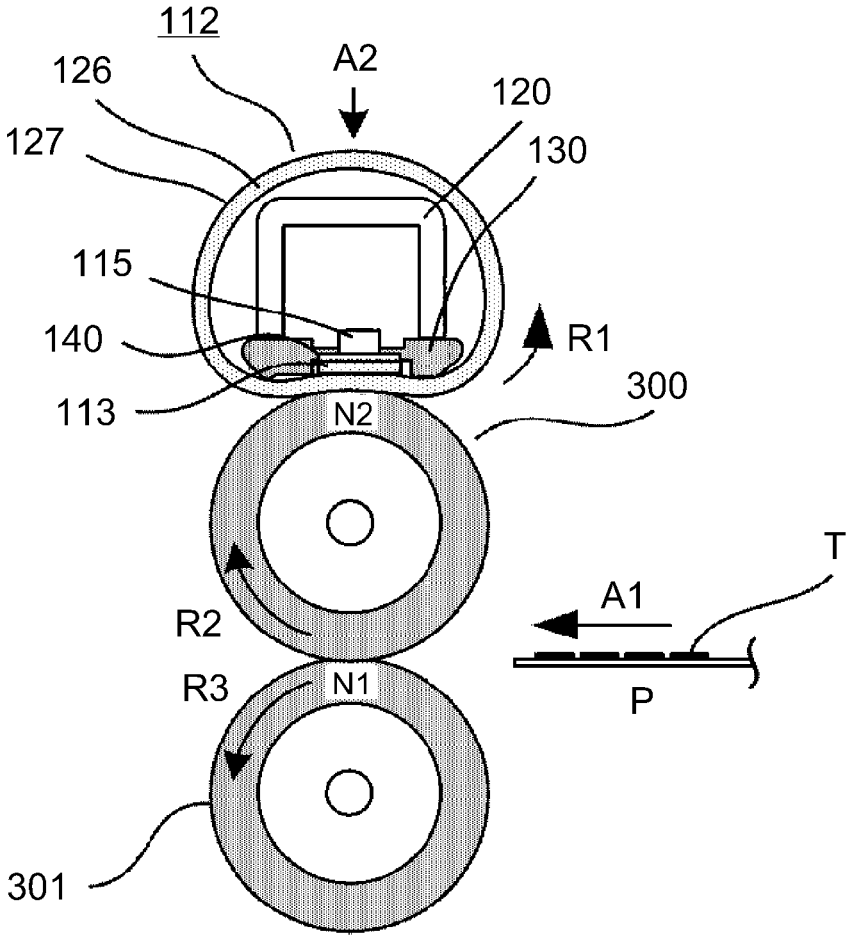
FIG. 12 is an illustration of a principal part of another embodiment.

(2) In the above-described fixing device, a device constitution in which the toner image is fixed on the sheet P at the fixing nip No formed by the fixing film 112 and the pressing roller 110 was described, but the present invention may also be applied to a fixing device of an external heating type, as shown in FIG. 12.

This fixing device heats the surface of a fixing roller 300 at a heating nip N2 by press-contact of the fixing film 112, in which the heater 113 is incorporated with the fixing roller 300. A constitution in which the toner image T is fixed on the sheet P at a fixing nip N1 formed by press-contact of a pressing roller 301 with the fixing roller 300 is employed.

In such a fixing device of the external heating type, in a case in which the heat-conductive members 140 are provided on the back surface of the heater 113, the preventing portions 140*a* of the heat-conductive members 140 are provided at portions in which the widthwise width of the fixing nip No is broad. As a result, similarly as in the above-described embodiments, it is possible to suppress the positional deviation and the deformation of the heat-conductive members 140.

(3) As regards the shape of the preventing portions 140*a* of the heat-conductive members 140 described above, only a shape (constitution) in which the heat-conductive members 140 are bent toward the heater holder 130 side, as in the case of the preventing portions 140*a* shown in FIG. 5, was used, but the shape of the preventing portions 140*a* is not limited thereto.

Figure 13:
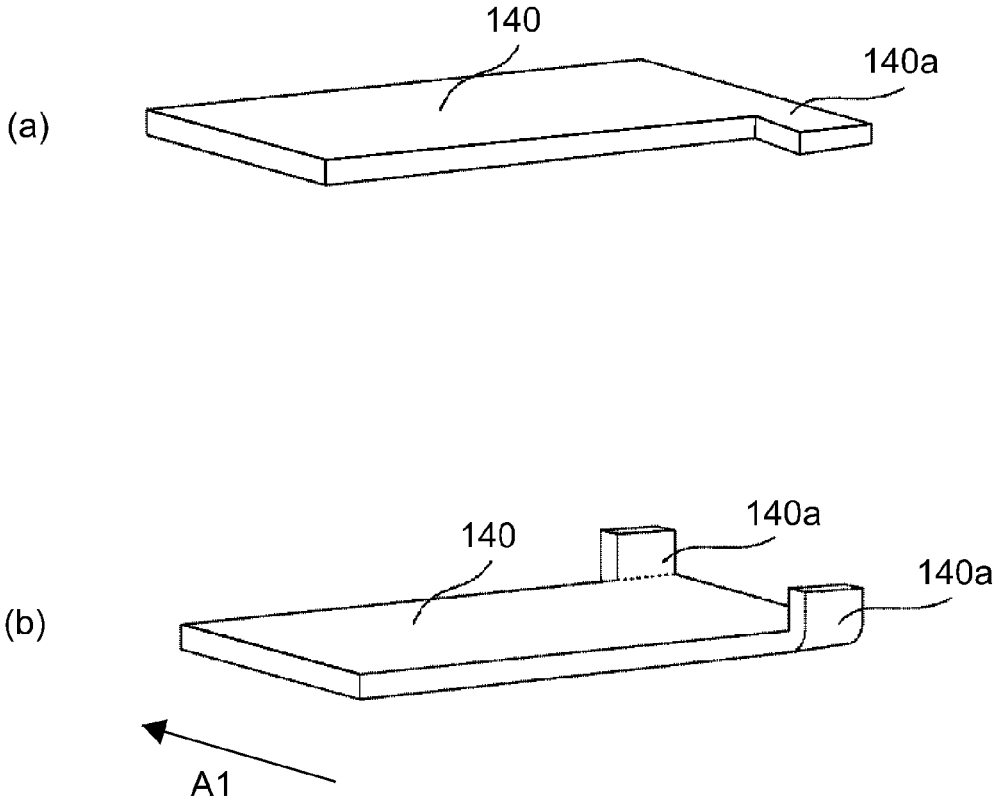
In FIG. 13, parts (a) and (b) are illustrations each showing a principal part of another embodiment.

For example, as shown in part (a) of FIG. 13, the shape is not the bent shape, but may also be a planar preventing portion shape that is flush with the contact surface of the heat-conductive member 140 with the heater 113. Further, as shown in part (b) of FIG. 13, a constitution in which a plurality of preventing portions 140*a* are also disposed in an upstream side and a downstream side with respect to the sheet feeding direction A1 was used. When the plurality of preventing portions 140*a* are provided, a force of the heat-conductive members 140 due to the thermal expansion can be distributed and regulated, and, therefore, it is possible to further suppress the positional deviation and the deformation with respect to the longitudinal direction.

(4) Further, the constitution in which the positions of the above-described heat-conductive members 140 correspond to the regions that extend along the longitudinal direction of the fixing nip No and that have a broad widthwise width was described above. When the preventing portions 140*a* are provided at positions with respect to the longitudinal direction of the fixing nip No, closer to the broad widthwise width portion than an intermediary widthwise width portion of the broad and narrow widthwise width portions, it is possible to alleviate the positional deviation and the deformation with respect to the longitudinal direction of the heat-conductive members 140.

(5) In the above-described embodiment, as the image heating apparatus, the fixing device for heating and fixing the unfixed toner image on the sheet (recording material) was described as an example, but the present invention is not limited thereto. The present invention is also applicable to an apparatus (device) for increasing a gloss (glossiness) of the image by re-heating the toner image that has been fixed or temporarily fixed on the sheet P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device for fixing an image on a recording material, said fixing device comprising:

a cylindrical belt;

a heater for heating said cylindrical belt, said heater including an elongated substrate and a heat generating resistor provided on said elongated substrate;

a heat-conductive member contacting a surface of said heater opposite from a belt contacting surface of said heater, wherein said heat-conductive member has a thermal conductivity greater than that of said elongated substrate, and wherein said heat-conductive member is divided into two members, each of said two members including one end portion that is located in a region of said heat-conductive member corresponding to a longitudinal end portion of said heat-conductive member, and another end portion that is located in a region of said heat-conductive member corresponding to a longitudinal central portion of said heat-conductive member;

a supporting member for supporting said heater through said heat-conductive member;

a bias member for applying pressure to said supporting member; and a pressing member for forming a nip through said cylindrical belt in cooperation with said heater by the pressure of said bias member, wherein, in the nip, the image is fixed on the recording material by being heated while the recording material, on which the image is formed, is fed, wherein the nip includes a region in which a width of the nip, with respect to a feeding direction of the recording material, gradually increases from a longitudinal central portion of the nip toward a longitudinal end portion of the nip, and wherein the one end portion of each of said two members of said heat-conductive member includes a regulating portion, extending in a longitudinal direction of said heater, for regulating movement of said heat-conductive member relative to said supporting member in the longitudinal direction of said heater, and the other end portion of each of said two members does not include the regulating portion extending in the longitudinal direction of said heater.

2. The fixing device according to claim 1, wherein said heat-conductive member is a metal plate, and said regulating portion of each of said two members is a bent portion obtained by bending a portion of said metal plate toward said supporting member.

3. The fixing device according to claim 1, wherein said regulating portion of each of said two members is provided outside of a feeding region through which a recording material, having a maximum width, is feedable by said fixing device.

* * * * *